US010539308B2

(12) United States Patent
Bernard et al.

(10) Patent No.: US 10,539,308 B2
(45) Date of Patent: Jan. 21, 2020

(54) MODULAR OVERHEAD LIGHTING SYSTEM

(71) Applicant: IDEAL Industries Lighting LLC, Sycamore, IL (US)

(72) Inventors: Randy Bernard, Cary, NC (US); Eric Marsh, Raleigh, NC (US); Mai Zakerin, Chapel Hill, NC (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 20 days.

(21) Appl. No.: 15/868,271

(22) Filed: Jan. 11, 2018

(65) Prior Publication Data

US 2018/0224104 A1 Aug. 9, 2018

Related U.S. Application Data

(60) Provisional application No. 62/455,294, filed on Feb. 6, 2017.

(51) Int. Cl.

| | |
|---|---|
| ***F21V 21/35*** | (2006.01) |
| ***F21V 23/06*** | (2006.01) |
| ***F21S 8/04*** | (2006.01) |
| ***H01R 25/14*** | (2006.01) |
| ***H01R 13/73*** | (2006.01) |

(Continued)

(52) U.S. Cl.

CPC ..... *F21V 21/35* (2013.01); *F21S 8/04* (2013.01); *F21V 23/06* (2013.01); *H01R 13/73* (2013.01); *H01R 25/006* (2013.01); *H01R 25/142* (2013.01); *H01R 25/145* (2013.01); *F21Y 2115/10* (2016.08)

(58) Field of Classification Search

CPC .. F21S 8/028; F21V 1/08; F21V 21/14; F21V 21/28; F21V 21/34

USPC ..... 362/418, 382, 248, 439

See application file for complete search history.

(56) References Cited

U.S. PATENT DOCUMENTS

| | | | |
|---|---|---|---|
| 7,213,940 | B1 | 5/2007 | Van De Ven et al. |
| 7,614,759 | B2 | 11/2009 | Negley |
| 8,736,186 | B2 | 5/2014 | Chobot |

(Continued)

OTHER PUBLICATIONS

Cree, Inc., "2016 LED Lighting Product Guide," 2nd Edition, Cree, Inc., Available online at: <<https://wabashelectric.com/ASSETS/DOCUMENTS/ITEMS/EN/Cree_CR14_22L_40K_S_Catalog.pdf>>, Last revised Jul. 26, 2016, 24 pages.

(Continued)

*Primary Examiner* — Edwyn Labaze

(74) *Attorney, Agent, or Firm* — Withrow & Terranova, P.L.L.C.

(57) ABSTRACT

A modular overhead lighting system includes a raceway element and one or more interchangeable lighting modules capable of variable positioning relative to the raceway element. Multiple raceway conductors are mounted in the raceway element, with a portion of each raceway conductor being exposed along a lower surface thereof to facilitate continuously variable positioning of lighting modules. An electrical connector for establishing electrical connections between a raceway element and a lighting module includes multiple ridges incorporating electrical contacts configured to contact raceway conductors, and includes terminals to removably receive electrical wires permitting electrical communication between a lighting module and the raceway element.

22 Claims, 16 Drawing Sheets

(51) Int. Cl.
*H01R 25/00* (2006.01)
*F21Y 115/10* (2016.01)

(56) References Cited

U.S. PATENT DOCUMENTS

| | | | | |
|---|---|---|---|---|
| 8,829,821 | B2 | 9/2014 | Chobot et al. | |
| 8,912,735 | B2 | 12/2014 | Chobot et al. | |
| 8,975,827 | B2 | 3/2015 | Chobot et al. | |
| 9,155,165 | B2 | 10/2015 | Chobot | |
| 9,155,166 | B2 | 10/2015 | Chobot | |
| 9,303,823 | B2 | 4/2016 | Hu et al. | |
| 9,433,061 | B2 | 8/2016 | Chobot | |
| 2003/0223231 | A1* | 12/2003 | McCarthy | F21S 2/00 362/219 |
| 2013/0141904 | A1* | 6/2013 | Verfuerth | F21V 15/01 362/221 |
| 2013/0328073 | A1 | 12/2013 | Lowes et al. | |
| 2014/0001959 | A1 | 1/2014 | Motley et al. | |
| 2014/0268790 | A1 | 9/2014 | Chobot et al. | |
| 2015/0008827 | A1 | 1/2015 | Carrigan et al. | |
| 2015/0008828 | A1 | 1/2015 | Carrigan et al. | |
| 2015/0008831 | A1 | 1/2015 | Carrigan et al. | |
| 2015/0015145 | A1 | 1/2015 | Carrigan et al. | |
| 2015/0048758 | A1 | 2/2015 | Carrigan et al. | |
| 2015/0102729 | A1 | 4/2015 | Creasman et al. | |
| 2015/0195883 | A1 | 7/2015 | Harris et al. | |
| 2015/0264780 | A1 | 9/2015 | Harris et al. | |
| 2015/0312983 | A1 | 10/2015 | Hu et al. | |
| 2015/0351187 | A1 | 12/2015 | McBryde et al. | |
| 2017/0228874 | A1 | 8/2017 | Roberts | |
| 2017/0230364 | A1 | 8/2017 | Barile et al. | |
| 2017/0231045 | A1 | 8/2017 | Hu et al. | |
| 2017/0231060 | A1 | 8/2017 | Roberts et al. | |
| 2017/0231061 | A1 | 8/2017 | Deese et al. | |
| 2017/0231066 | A1 | 8/2017 | Roberts et al. | |
| 2018/0098201 | A1 | 4/2018 | Torello et al. | |
| 2018/0103529 | A1 | 4/2018 | Carrigan et al. | |

OTHER PUBLICATIONS

Nordeon, "Baldur: SKADI—Spotlight," Nordeon Group, Available online at: <<https://www.nordeon.com/fileadmin/nordeon/Daten_09-2017/Downloads/Skadi_mounting_140718.pdf>>, Jul. 2014, 3 pages.

Nordeon, "Baldur: PRC—Sensor Switch," Nordeon Group, Available online at: <<https://www.rego-lighting.de/wp-content/uploads/2017/04/Montageanleitung_Baldur_PRC.pdf>>, Feb. 2016, 6 pages.

Nordeon, "Baldur: Trunking—System," Nordeon Group, Available online at: <<https://www.ledtronic.ch/images/produkte/industrie-und-gewerbe/led-lichtbandsystem/baldur/Montageanleitung/Baldur_general.pdf>>, Feb. 2016, 7 pages.

Nordeon, "Baldur: Datasheet," Nordeon Group, Available online at: <<https://www.nordeon.com/fileadmin/nordeon/Daten_09-2017/Downloads/Baldur_en.pdf>>, Sep. 2017, 8 pages.

* cited by examiner

MODULAR OVERHEAD LIGHTING SYSTEM

CROSS-REFERENCE TO RELATED APPLICATION(S)

This application claims benefit of priority to U.S. Provisional Patent Application No. 62/455,294 filed on Feb. 6, 2017, wherein the entire contents of the foregoing application are hereby incorporated by reference herein.

TECHNICAL FIELD

The disclosure relates to overhead lighting systems and related fabrication methods. In particular aspects, the disclosure relates to a modular overhead lighting system including one or more types of interchangeable lighting modules that are capable of being mounted at any one of numerous positions along a raceway element, and components of such a system.

BACKGROUND

Overhead lighting systems are often used in a variety of types of indoor spaces. Lighting systems may include a large number of light fixtures, especially in large spaces. Installation, servicing, replacement and/or reconfiguration of such light fixtures may entail significant time and expense, particularly if each light fixture is electrically and/or mechanically independent from one another (e.g., independently electrically wired and/or independently mounted, etc.).

In some instances, a lighting system may include a mounted infrastructure that dictates specific positions and/or types of lights that can be used. Such a design may complicate installation, servicing, and/or replacement of lighting components. Further, there may be limitations regarding modifying the layout of the lighting system, particularly with respect to using different types and/or placements of light fixtures. For example, replacement of a linear light with a spotlight, and/or repositioning of the spotlight, may require replacement of the underlying infrastructure which can be expensive, time consuming, and/or complicated, particularly with respect to the electrical wiring and mechanical installation.

Accordingly, the art continues to seek improved lighting systems that provide modularity and are capable of overcoming challenges associated with conventional lighting systems.

SUMMARY

Aspects of the disclosure relate to a modular overhead lighting system, as well as methods of installing and using the modular overhead lighting system. The modular overhead lighting system includes a raceway element and one or more interchangeable lighting modules capable of variable positioning relative to the raceway element. The raceway element includes a plurality of raceway conductors mounted therein, wherein a portion of each raceway conductor is exposed along a lower surface thereof to facilitate variable positioning (e.g., continuously variable positioning) of lighting modules relative to the raceway element. Lighting modules are configured for mechanical and electrical coupling to the raceway element at any of a number of different positions, including a first module position and a second module position that overlaps with the first module position. In certain embodiments, a lighting module comprises an electrical connector for establishing electrical connections between a raceway element and a lighting module. The electrical connector includes a plurality of ridges incorporating a plurality of electrical contacts configured to contact a plurality of raceway conductors. The electrical connector also includes a plurality of terminals configured to removably receive electrical wires for establishing and/or altering electrical communication between the lighting module and the raceway element.

In one aspect, a raceway element is configured to support at least one light fixture from above. The raceway element includes a plurality of raceway walls including a left raceway wall, a right raceway wall opposing the left raceway wall, and an upper raceway wall spanning generally between the left raceway wall and the right raceway wall; a first raceway conductor; and a second raceway conductor. At least a portion of the left raceway wall and at least a portion of the right raceway wall extend downward relative to the upper raceway wall. The first raceway conductor extends substantially an entire length of at least one raceway wall of the plurality of raceway walls. The first raceway conductor is arranged within a first channel defined by at least one insulating element, and at least 50% of the first channel is devoid of a lower boundary such that at least 50% of a length of the first raceway conductor is exposed along a lower surface of the at least one insulating element. The second raceway conductor extends substantially the entire length of the at least one raceway wall of the plurality of raceway walls. The second raceway conductor is arranged within a second channel defined by the at least one insulating element, and at least 50% of the second channel is devoid of a lower boundary such that at least 50% of a length of the second raceway conductor is exposed along a lower surface of the at least one insulating element.

In certain embodiments, the at least one insulating element comprises a first insulating element arranged on or supported by the left raceway wall, and a second insulating element arranged on or supported by the right raceway wall. In certain embodiments, the first insulating element comprises a first extruded insert mechanically retained by the left raceway wall; and the second insulating element comprises a second extruded insert mechanically retained by the right raceway wall.

In certain embodiments, the first raceway conductor is arranged proximate to a medial surface of the left raceway wall, and the second raceway conductor is arranged proximate to a medial surface of the right raceway wall.

In certain embodiments, the at least one insulating element is embodied in a single insulating element supported by at least one raceway wall of the plurality of raceway walls.

In certain embodiments, the raceway element further includes a lengthwise extension of at least one raceway wall of the plurality of raceway walls, wherein the lengthwise extension is devoid of one or more of the first raceway conductor or the second raceway conductor.

In certain embodiments, the at least one insulating element comprises at least one extruded insert that is mechanically retained by at least one raceway wall of the plurality of raceway walls.

In certain embodiments, medial, lateral, and upper portions of each of the first channel and the second channel are bounded by the at least one insulating element.

In certain embodiments, the left raceway wall comprises a distal surface that opposes a medial surface of the left raceway wall, the right raceway wall comprises a distal surface that opposes a medial surface of the right raceway wall, and the raceway element further comprises: at least one of (i) a first longitudinal groove defined in the distal surface of the left raceway wall or (ii) a first longitudinal lip protruding from the distal surface of the left raceway wall; and at least one of (i) a second longitudinal groove defined in the distal surface of the right raceway wall or (ii) a second longitudinal lip protruding from the distal surface of the right raceway wall.

In certain embodiments, the raceway element further includes a third raceway conductor extending substantially the entire length of the at least one raceway wall of the plurality of raceway walls, wherein the third raceway conductor is arranged within a third channel defined by the at least one insulating element, and at least 50% of the third channel is devoid of a lower boundary such that at least 50% of a length of the third raceway conductor is exposed along a lower surface of the at least one insulating element; and a fourth raceway conductor extending substantially the entire length of the at least one raceway wall of the plurality of raceway walls, wherein the fourth raceway conductor is arranged within a fourth channel defined by the at least one insulating element, and at least 50% of the fourth channel is devoid of a lower boundary such that at least 50% of a length of the fourth raceway conductor is exposed along a lower surface of the at least one insulating element.

In certain embodiments, each of the first channel, the second channel, the third channel, and the fourth channel is horizontally offset from the others.

In certain embodiments, the raceway element further includes a fifth raceway conductor extending substantially the entire length of the at least one raceway wall of the plurality of raceway walls, wherein the fifth raceway conductor is arranged within a fifth channel defined by the at least one insulating element, and at least 50% of the fifth channel is devoid of a lower boundary such that at least 50% of a length of the fifth raceway conductor is exposed along a lower surface of the at least one insulating element, wherein the fifth raceway conductor is configured to provide electrical grounding.

In certain embodiments, the upper raceway wall comprises a plurality of holes and is configured for flush mounting to a ceiling structure.

In certain embodiments, the upper raceway wall comprises a longitudinal channel configured to receive suspension elements and is configured to be suspended below a ceiling structure.

In another aspect, a modular lighting apparatus includes a raceway element and a lighting module, wherein the lighting module is configured for mechanical and electrical coupling to the raceway element at any one module position of a plurality of module positions, wherein the plurality of module positions includes first and second module positions that overlap with one another. The raceway element includes a left raceway wall, a right raceway wall opposing the left raceway wall, an upper raceway wall spanning generally between the left raceway wall and the right raceway wall, a plurality of electrical conductors, and a first mechanical coupling structure; wherein at least a portion of the left raceway wall and at least a portion of the right raceway wall extend downward relative to the upper raceway wall. The lighting module includes a housing, at least one light-emitting element supported by the housing; and an electrical interconnect structure. The housing comprises a left housing wall, a right housing wall opposing the left housing wall, a transverse support arranged between the left housing wall and the right housing wall, and a second mechanical coupling structure configured to mate with the first mechanical coupling structure for removable attachment of the housing to the raceway element. The electrical interconnect structure provides a plurality of electrical connections between the lighting module and the raceway element.

In certain embodiments, the lighting module is configured for mechanical and electrical coupling to the raceway element at any continuously variable position between the first module position and the second module position.

In certain embodiments, the housing of the lighting module is configured to be attached to the raceway element by vertical translation of the housing relative to the raceway element, and wherein the housing is non-rotatable relative to the raceway element once attached thereto.

In certain embodiments, the raceway element is configured to be electrically interconnected with at least one other raceway element.

In certain embodiments, the at least one light-emitting element and the housing are embodied in at least one light fixture.

In certain embodiments, the at least one light-emitting element comprises a plurality of LEDs, the at least one light fixture comprises a lens or diffuser, the lens or diffuser is attached to a lower portion of the housing, and the plurality of LEDs is positioned between the transverse support of the housing and the lens or diffuser.

In certain embodiments, the lighting module further comprises a driver mounted within the housing, and the driver is electrically coupled between the electrical interconnect structure and the plurality of LEDs. In certain embodiments, the modular lighting apparatus further includes a bracket configured to elevate the driver relative to the transverse support.

In certain embodiments, the at least one light-emitting element comprises at least one of a pendant light, a spotlight, or a floodlight. The at least one light-emitting element may embody a track-type light fixture configured to be mechanically and electrically connected to a track (e.g., a track adapter) supported by a housing of a lighting module.

In certain embodiments, the lighting module comprises a track supported by the housing, wherein the track provides mechanical and electrical connections with the at least one light-emitting element, and the at least one light-emitting element is embodied in at least one track light fixture that is positionable at any one of multiple positions along the track.

In certain embodiments, the at least one track light fixture comprises a driver configured to supply at least one electrical signal to the at least one light-emitting element.

In certain embodiments, at least a portion of each electrical conductor of the plurality of electrical conductors is exposed along a lower surface thereof within the raceway element.

In certain embodiments, the electrical interconnect structure comprises an electrical connector comprising: a base portion; a plurality of ridges extending upwardly from the base portion and a plurality of electrical contacts associated with the plurality of ridges, wherein each ridge of the plurality of ridges comprises an insulating material and comprises a different electrical contact of the plurality of electrical contacts, and each electrical contact of the plurality of electrical contacts is configured to contact a different electrical conductor of the plurality of electrical conductors of the raceway element; and a plurality of terminals defined in or on the base portion and configured to receive a plurality of electrical wires from the lighting module, wherein each terminal of the plurality of terminals is in conductive electrical communication with a different electrical contact of the plurality of electrical contacts, and each terminal of the plurality of terminals is configured to removably receive a different electrical wire of the plurality of electrical wires.

In certain embodiments, the electrical connector is separable from the housing, the electrical connector is configured to be mechanically coupled to an interior of the raceway element, and the housing is configured to be mechanically coupled to an interior of the raceway element.

In certain embodiments, the electrical connector is configured to be engaged to the raceway element at any one connector position of a plurality of connector positions, wherein the plurality of connector positions includes first and second connector positions that overlap with one another.

In another aspect, an electrical connector for establishing electrical connections between a raceway element and a light fixture comprises: a base portion, a plurality of ridges extending upwardly from the base portion, a plurality of electrical contacts associated with the plurality of ridges, and a plurality of terminals, wherein the electrical connector is configured to be mechanically and electrically coupled to the raceway element upon vertical translation of the electrical connector into at least a portion of the raceway element. Each ridge of the plurality of ridges comprises an insulating material and comprises a different electrical contact of the plurality of electrical contacts, and each electrical contact of the plurality of electrical contacts is configured to contact a different electrical conductor of a plurality of electrical conductors of the raceway element. The plurality of terminals is defined in or on the base portion and is configured to receive a plurality of electrical wires from the light fixture, wherein each terminal of the plurality of terminals is in conductive electrical communication with a different electrical contact of the plurality of electrical contacts, and each terminal of the plurality of terminals is configured to removably receive a different electrical wire of the plurality of electrical wires.

In certain embodiments, the plurality of ridges is integrally formed with the base portion.

In certain embodiments, the plurality of ridges comprises a first ridge extending upward from a left upper edge of the base portion and a second ridge extending upward from a right upper edge of the base portion. In certain embodiments, the first ridge comprises a height that differs relative to a height of the second ridge.

In certain embodiments, the plurality of ridges comprises first and second ridges extending upward from a left upper edge of the base portion and comprises third and fourth ridges extending upward from a right upper edge of the base portion.

In certain embodiments, each electrical contact of the plurality of electrical contacts is positioned at a top of the plurality of ridges.

In certain embodiments, the plurality of ridges comprises at least four ridges; the plurality of electrical contacts comprises at least four electrical contacts; and the plurality of terminals comprises at least four terminals.

In certain embodiments, each terminal of the plurality of terminals comprises an opening defined in the base portion.

In certain embodiments, each terminal of the plurality of terminals comprises a mechanical securement feature to secure a different electrical wire of the plurality of electrical wires therein.

In certain embodiments, the electrical connector further includes a mechanical retention feature configured to cooperate with a corresponding mechanical engagement feature of the raceway element. In certain embodiments, the mechanical retention feature comprises at least one outwardly biased engagement arm extending upward from the base portion, and the least one outwardly biased engagement arm includes a prong arranged at or proximate to an end thereof. In certain embodiments, the electrical connector is non-rotatable relative to the raceway element when mechanically connected with the raceway element.

In certain embodiments, the plurality of terminals is configured to receive the plurality of electrical wires from a driver of the light fixture.

In another aspect, a method for fabricating a modular lighting system includes: mounting a raceway element to or below a ceiling; attaching an electrical connector of a lighting module into the raceway element at a first connector position to establish conductive electrical communication between a plurality of electrical conductors of the raceway element and a plurality of electrical contacts arranged atop a plurality of ridges of the electrical connector, wherein the electrical connector is electrically coupled with a driver electrically coupled with a light fixture; and attaching a housing of the lighting module to left and right raceway walls of the raceway element at a first housing position, such that the housing, the driver, and the light fixture are supported by the raceway element.

In certain embodiments, the attaching of the electrical connector into the raceway element comprises vertical translation of the electrical connector relative to the raceway element without rotation of the electrical connector.

In certain embodiments, the method further includes coupling a plurality of electrical wires of the driver to a plurality of electrical terminals of the electrical connector prior to the attaching of the electrical connector into the raceway element. In certain embodiments, the method further includes decoupling the plurality of electrical wires from a first combination of terminals of the plurality of electrical terminals, and recoupling the plurality of electrical wires to a second combination of terminals of the plurality of electrical terminals to alter electrical communication between the raceway element and the lighting module.

In certain embodiments, the housing is configured to be attached to the raceway element at any one housing position of a plurality of housing positions, the plurality of housing positions includes the first housing position and a second housing position that overlap with one another, and the method further comprises repositioning the housing from the first housing position to the second housing position.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the disclosure, and together with the description serve to explain the principles of the disclosure.

DETAILED DESCRIPTION

Figure 1A:
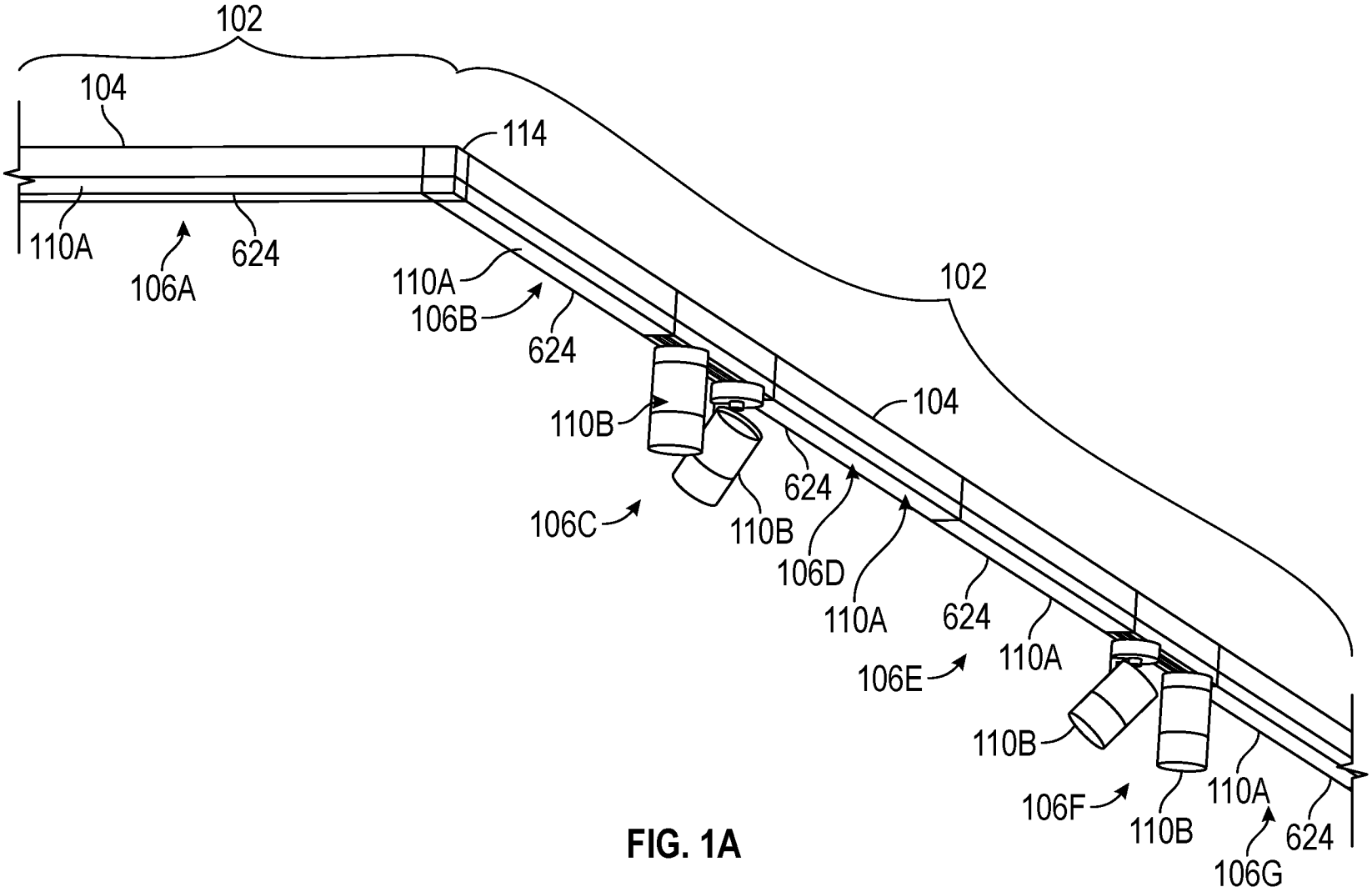
FIG. 1A is a lower perspective view of a modular overhead lighting system including one or more lighting apparatuses, with each lighting apparatus including a raceway element and one or more lighting modules in electrical and mechanical communication with the raceway element.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

The disclosure relates to a modular lighting apparatus comprising a raceway element configured to receive at least one lighting module, with each lighting module preferably including at least one light fixture (optionally, multiple light fixtures). The raceway element is configured to be mounted to or suspended from a ceiling, and is configured to support at least one lighting module from above. Components of a modular lighting apparatus are also disclosed. A lighting system may include multiple interconnected raceway elements each configurable to receive one or more lighting modules.

In certain embodiments, a raceway element serves as a mechanical mount and electrical bus, for receiving and powering one or more lighting modules. In certain embodiments, a raceway element includes a plurality of raceway conductors mounted therein, wherein at least a substantial portion (e.g., at least 50% of a length) of each raceway conductor of the plurality of raceway conductors is exposed along a lower surface thereof to facilitate variable positioning of a lighting module relative to the raceway element.

In certain embodiments, each raceway conductor of the plurality of raceway conductors extends substantially an entire length of at least one raceway wall of a plurality of raceway walls that constitute the raceway element. Optionally, the raceway element may further include a lengthwise extension of at least one raceway wall of the plurality of raceway walls, wherein the lengthwise extension is devoid of one or more raceway conductors of the plurality of raceway conductors. In this regard, an optional lengthwise extension devoid of a raceway conductor should not be considered part of a raceway wall as disclosed herein.

In certain embodiments, a raceway element includes multiple conductors associated with a single raceway wall (e.g., first and second conductors arranged on or supported by a left raceway wall, a right raceway wall, or an upper raceway wall). In certain embodiments, a raceway element may include one or more raceway conductors associated with a left raceway wall and one or more raceway conductors associated with a right raceway wall, with such arrangement preferably providing a substantially unobstructed central interior portion of the raceway element to enable (i) fasteners to be inserted through an upper raceway wall to permit the raceway element to be mounted to an overhead (e.g., ceiling) structure and/or (ii) one or more portions of an electrical interconnect structure and/or one or more portions of a lighting module (such as a driver) to be at least partially received within the raceway element. In certain embodiments, a raceway element comprises a left raceway wall, a right raceway wall opposing the left raceway wall, an upper raceway wall spanning generally between the left raceway wall and the right raceway wall, a plurality of electrical conductors, and a first mechanical coupling structure. In certain embodiments, the left raceway wall and the right raceway wall are substantially parallel to one another, with major surfaces being substantially perpendicular to a major surface of the upper raceway wall. In certain embodiments, the upper raceway wall may be positioned at a top of the raceway. At least a portion of the left raceway wall and at least a portion of the right raceway wall extend downward relative to the upper raceway wall. The left raceway wall comprises a distal surface that opposes a medial surface of the left raceway wall, and the right raceway wall comprises a distal surface that opposes a medial surface of the right raceway wall. In certain embodiments, the raceway element further comprises at least one of (i) a first longitudinal groove defined in the distal surface of the left raceway wall or (ii) a first longitudinal lip protruding from the distal surface of the left raceway wall, and at least one of (i) a second longitudinal groove defined in the distal surface of the right raceway wall or (ii) a second longitudinal lip protruding from the distal surface of the right raceway wall, with the foregoing grooves or lips being configured for receiving complementary features of a lighting module to facilitate mechanical coupling therebetween. In certain embodiments, a upper raceway wall defines a plurality of holes and is configured for flush mounting to a ceiling structure. In other embodiments, a upper raceway wall includes a longitudinal channel configured to receive suspension elements (e.g., terminated along ends of cables, chains, or the like) and is configured to be suspended below a ceiling structure.

In certain embodiments, at least a portion of each electrical conductor of the plurality of electrical conductors associated with a raceway element is exposed along a lower surface thereof within the raceway element. In certain embodiments, while at least a substantial portion of a lower surface of each electrical conductor (also referred to herein as a "raceway conductor") of the plurality of electrical conductors is exposed, remaining upper surfaces and lateral surfaces (or medial and lateral surfaces) of each electrical conductor are insulated, such as by being bounded by at least one insulating element that supports the electrical conductor(s) in or along an interior of a raceway element.

In certain embodiments, each raceway conductor of a plurality of raceway conductors extends substantially an entire length of at least one raceway wall of a plurality of raceway walls (e.g., including left, right and upper raceway walls), without a length of a raceway wall including any optional lengthwise extension thereof that is devoid of any raceway conductors.

In certain embodiments, a first raceway conductor extends substantially an entire length of the left raceway wall proximate to the medial surface of the left raceway wall. The first raceway conductor is arranged within a first channel defined by a first insulating element, and at least 50% (or at least 60%, at least 70%, at least 80%, at least 90%, or 100%) of the first channel is devoid of a lower boundary such that at least 50% (or at least 60%, at least 70%, at least 80%, at least 90%, or 100%) of a length of the first raceway conductor is exposed along a lower surface thereof. A second raceway conductor extends substantially an entire length of the right raceway wall proximate to the medial surface of the right raceway wall. The second raceway conductor is arranged within a second channel defined by a second insulating element, and at least 50% (or another threshold percentage specified above, including but not limited to 100%) of the second channel is devoid of a lower boundary such that at least 50% (or another threshold percentage specified above, including but not limited to 100%) of a length of the second raceway conductor is exposed along a lower surface thereof. The preceding two raceway conductors may provide one controllable circuit. In certain embodiments, additional conductors may be present to provide one or more separately controllable circuits and/or a ground. For example, in certain embodiments, third raceway conductor extends substantially the entire length of the left raceway wall proximate to the medial surface of the left raceway wall. The third raceway conductor is arranged within a third channel defined by the first insulating element, and at least 50% (or another threshold percentage identified above) of the third channel is devoid of a lower boundary such that at least 50% (or another threshold percentage identified above, including but not limited to 100%) of a length of the third raceway conductor is exposed along a lower surface thereof. In certain embodiments, a fourth raceway conductor extends substantially the entire length of the right raceway wall proximate to the medial surface of the right raceway wall. The fourth raceway conductor is arranged within a fourth channel defined by the second insulating element, and at least 50% (or another threshold percentage identified above, including but not limited to 100%) of the fourth channel is devoid of a lower boundary such that at least 50% (or another threshold percentage identified above, including but not limited to 100%) of a length of the fourth raceway conductor is exposed along a lower surface thereof. In certain embodiments, a fifth raceway conductor extends substantially the entire length of the left raceway wall proximate to the medial surface of the left raceway wall. Alternatively, a fifth raceway conductor may be associated with the right raceway wall. The fifth raceway conductor is arranged within a fifth channel defined by the first insulating element, and at least 50% (or another threshold percentage identified above, including but not limited to 100%) of the fifth channel is devoid of a lower boundary such that at least 50% (or another threshold percentage identified above, including but not limited to 100%) of a length of the fifth raceway conductor is exposed along a lower surface thereof, wherein the fifth raceway conductor is configured to provide electrical grounding.

In certain embodiments, a raceway element is configured to be mechanically and/or electrically interconnected with at least one other raceway element. In certain embodiments, a raceway element may be fabricated of multiple raceway sections that may be electrically connected with one another, such as in straight, angled (e.g., perpendicular or non-perpendicular), crossing, or curved configurations.

In certain embodiments, one or more raceway walls of a raceway element may be fabricated of an electrically insulating material and thereby form at least one insulating element defining channels for receiving raceway conductors. In certain embodiments, one or more raceway walls of a raceway may be fabricated of conductive materials to which at least one insulating element may be attached, with the at least one insulating element defining channels for receiving raceway conductors. In certain embodiments, a single insulating element defining multiple (e.g., two, three, four, five or more) channels may be mounted to or otherwise associated with a single raceway wall (e.g., an upper raceway wall, a left raceway wall, or a right raceway wall). In other embodiments, a first insulating element may be mounted to or associated with a first raceway wall, and a second insulating element may be mounted to or associated with a second raceway wall, where the first and second raceway walls are selected from an upper raceway wall, a left raceway wall, and a right raceway wall.

In certain embodiments, the first insulating element comprises a first extruded insert mechanically retained by the left raceway wall, and the second insulating element comprises a second extruded insert mechanically retained by the right raceway wall. In embodiments incorporating four or more insulating elements each configured to receive a different conductor, a first channel of a first insulating element is horizontally offset (and optionally is also vertically offset) from a third channel of the first insulating element, and a second channel of a second insulating element is horizontally offset from a fourth channel of the second insulating element. Such insulating elements permit conductors to avoid electrical interaction with raceway walls, which may be fabricated of conductive material (e.g., metal). In certain embodiments, the insulating elements may be integrally formed (e.g., coextruded) with raceway walls.

In certain embodiments, a lighting module comprises a housing, at least one light-emitting element supported by the housing, and an electrical interconnect structure providing a plurality of electrical connections between the lighting module and the raceway element. In certain embodiments, a housing may include a left housing wall, a right housing wall opposing the left housing wall, a transverse support arranged between the left housing wall and the right housing wall, and a second mechanical coupling structure configured to mate with the first mechanical coupling structure for removable attachment of the housing to the raceway element. Such a housing may be configured to be attached to the raceway element by vertical translation of the housing relative to the raceway element, with the housing being non-rotatable relative to the raceway element once attached thereto.

In certain embodiments, at least one light-emitting element and a housing are embodied in at least one light fixture. For example, the housing may contain a driver and include at least one wall that supports one or more light emitting elements (e.g., LEDs), and the at least one light-emitting element may include a lens or a diffuser arranged to transmit emissions of the one or more LEDs. In certain embodiments, a light fixture may include an array of LEDs embodied in an elongated linear light fixture.

In certain embodiments, a housing may receive a track (e.g., a track attachment) configured to receive one or more track-type light fixtures (e.g., spotlight fixtures, floodlight fixtures, pendant light fixtures, or the like). In certain embodiments, individual light fixtures that are supported by such a track may optionally include driver circuitry integral to the respective fixtures.

In certain embodiments, an electrical interconnect structure may be embodied in or include an electrical connector. In certain embodiments, an electrical connector is separable from a housing of a raceway element, the electrical connector is configured to be mechanically coupled to an interior of the raceway element, and the housing is configured to be mechanically coupled to an interior of the raceway element. In certain embodiments, an electrical connector may be configured to be engaged to the raceway element at any one of a plurality of connector positions, wherein the plurality of connector positions includes first and second connector positions that overlap with one another.

In certain embodiments, the electrical connector is configured to be mechanically and electrically coupled to the raceway element upon vertical translation of the electrical connector into at least a portion of the raceway element, without rotation of the electrical connector relative to the raceway element. The electrical connector includes a base portion, a plurality of ridges extending upwardly from the base portion, a plurality of electrical contacts associated with the plurality of ridges, and a plurality of terminals defined in or on the base portion and configured to receive a plurality of electrical wires from the lighting module. In certain embodiments, the plurality of ridges comprises at least four ridges, the plurality of electrical contacts comprises at least four electrical contacts, and the plurality of terminals comprises at least four terminals. Such an arrangement permits at least two pairs of conductors to embody at least two independently controllable circuits, which may be desirable to permit independent operation of different groups of lighting modules (and/or light fixtures associated with one or more lighting modules) thereof supported by one or more raceway elements.

In certain embodiments, each ridge of the plurality of ridges of an electrical connector comprises an insulating material and comprises a different electrical contact of the plurality of electrical contacts, with each electrical being configured to contact a different electrical conductor of a plurality of electrical conductors of the raceway element. In certain embodiments, each electrical contact of the plurality of electrical contacts is positioned at a top of a different ridge of the plurality of ridges. In certain embodiments, the plurality of ridges is integrally formed with the base portion. In certain embodiments, the plurality of ridges includes a first ridge extending upward from a left upper edge of the base portion and a second ridge extending upward from a right upper edge of the base portion. In certain embodiments, at least two ridges have different heights; for example, the first ridge may have a height that differs relative to a height of the second ridge. In certain embodiments, first and second ridges may extend upward from a left upper edge of the base portion and third and fourth ridges may extend upward from a right upper edge of the base portion.

In certain embodiments, an electrical connector includes a mechanical retention feature configured to cooperate with a corresponding mechanical engagement feature of the raceway element. In certain embodiments, a mechanical retention feature includes at least one outwardly biased engagement arm extending upward from the base portion, and the least one outwardly biased engagement arm includes a prong arranged at or proximate to an end thereof. Multiple outwardly biased engagement arms may be provided. In certain embodiments, an electrical connector is non-rotatable relative to a raceway element when mechanically connected with the raceway element.

In certain embodiments, a plurality of terminals associated with an electrical connector is configured to receive a plurality of electrical wires from a driver of a light fixture. In certain embodiments, each terminal is in conductive electrical communication with a different electrical contact of the plurality of electrical contacts associated with ridges of the electrical connectors. In certain embodiments, each terminal is configured to removably receive a different electrical wire. In certain embodiments, each terminal comprises an opening defined in the base portion. In certain embodiments, each terminal includes a mechanical securement feature to secure a different electrical wire therein.

In certain embodiments, a lighting module is configured for mechanical and electrical coupling to a raceway element at any one of a plurality of module positions, which includes first and second module positions that overlap with one another. Such a lighting module may be configured for mechanical and electrical coupling to the raceway element at any continuously variable position between the first module position and the second module position.

In certain embodiments, a lighting module includes a driver mounted within a housing, with the lighting module being electrically coupled between an electrical interconnect structure and at least one light-emitting element. The housing, at least one light-emitting element, and driver in combination may be embodied in a light fixture, such as an elongated linear light fixture. In certain embodiments, a bracket or other structure may be used to elevate the driver relative to a transverse support of the housing.

In certain embodiments, at least one light fixture associated with a lighting module disclosed herein includes a plurality of LEDs and a lens or diffuser. In certain embodiments, the lens or diffuser may be attached to a lower portion of the housing (optionally with a support plate, heat spreader, or similar component(s) arranged therebetween), with the plurality of LEDs being positioned between a transverse support of the housing and the lens or diffuser. In certain embodiments, at least one light fixture may include a pendant light, a spotlight, a floodlight, a track light, or a linear fixture. In certain embodiments, a lighting module may include a track providing mechanical and electrical connections with the at least one light fixture embodied in or including a track light fixture that is positionable at any one of multiple positions along the track. It is to be noted that the track of such a lighting module is distinct from the raceway element to which the lighting module is attached, and that a track-type light fixture may be independent of a housing of a lighting module. Thus, in certain embodiments, a housing may be part of a light fixture (e.g., in the case of certain linear light fixtures), whereas in other embodiments, a housing that supports a track (e.g., a track adapter) may be distinct from one or more light fixtures configured to be supported by the track.

In certain embodiments, a method for fabricating a modular lighting system includes multiple steps, including; mounting a raceway element to or below a ceiling, coupling a plurality of electrical wires of a driver to a plurality of electrical terminals of an electrical connector, and attaching the electrical connector into the raceway element. In certain embodiments, the method may further include decoupling the plurality of electrical wires from a first combination of terminals of the plurality of electrical terminals, and recoupling the plurality of electrical wires to a second combination of terminals of the plurality of electrical terminals to alter electrical communication between the raceway element and the lighting module.

In certain embodiments, a method includes attaching an electrical connector of a lighting module into the raceway element at a first connector position to establish conductive electrical communication between a plurality of electrical conductors of the raceway element and a plurality of electrical contacts arranged atop a plurality of ridges of the electrical connector, wherein the electrical connector is electrically coupled with a driver electrically coupled with a light fixture. The attaching of the electrical connector into the raceway element may include vertical translation of the electrical connector relative to the raceway element without rotation of the electrical connector.

In certain embodiments, a method includes attaching a housing of the lighting module to left and right raceway walls of a raceway element at a first housing position, such that the housing, the driver, and at least one light-emitting element (optionally embodied in a light fixture) are supported by the raceway element. In certain embodiments, the housing is configured to be attached to the raceway element at any one of a plurality of housing positions, with the plurality of housing positions including first and second housing positions that overlap with one another. A method may further include repositioning the housing from the first housing position to a second housing position.

Details of illustrative modular lighting systems are described hereinafter.

Figure 1B:
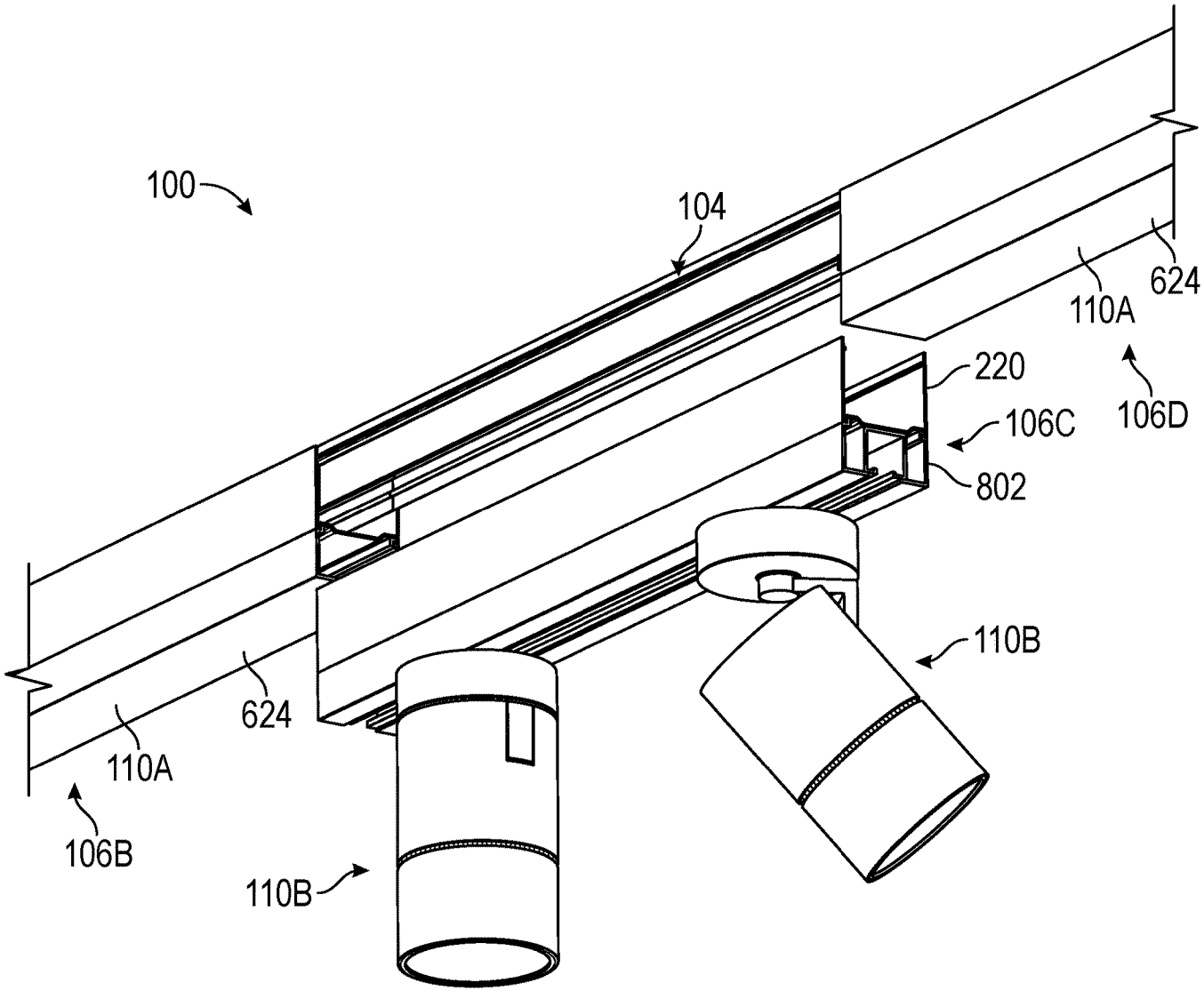
FIG. 1B is a lower perspective assembly view of a lighting apparatus of FIG. 1A, showing a lighting module including two track-mounted spotlights prior to attachment to a raceway element.

FIGS. 1A and 1B are views of a modular lighting system 100 (e.g., lighting system, modular overhead lighting system, etc.). Referring to FIG. 1A, the lighting system 100 includes a plurality of lighting apparatuses 102, where each lighting apparatus 102 includes at least one raceway element 104 (or a portion thereof) and one or more lighting modules 106A-106G attached to each raceway element 104. The lighting apparatus 102 may be any type and/or length (e.g., 4 ft., 8 ft., 2 ft. track lighting, 2 ft. down lighting, etc.). The appearance of the lighting apparatus 102 may be modified by anodizing, industrial appearance, and/or painting.

Each raceway element 104 provides structural support for mounting lighting modules 106A-106G to provide overhead lighting, and also provides electrical connection to the respective lighting modules 106A-106G. The raceway elements 104 of adjacent lighting apparatuses 102 may be electrically and/or mechanically interconnected with one another at straight or angled joints (e.g., at a corner joint 114), such as to create a common electrical busway. The raceway element 104 may be any length (e.g., 0.5 ft., 1 ft., 2 ft., 4 ft., 8 ft., 10 ft., etc.). As explained in more detail below, the raceway elements 104 may be of different types (e.g., suspension mount, flush mount, etc.) and/or different sizes (e.g., lengths) to accommodate different numbers and/or types of lighting modules and/or to address lighting layout considerations (e.g., to accommodate different sized rooms and desired illumination).

The lighting modules 106A-106G illuminate one or more designated areas. Each of the lighting modules 106A-106G may be of any suitable length (e.g., 0.5 ft., 1 ft., 2 ft., 4 ft., etc.). In certain embodiments, the raceway element 104 is longer than the lighting modules 106A-106G to accommodate multiple lighting modules 106A-106G on one raceway element 104. In this way, the raceway element 104 permits repositioning of lighting modules 106A-106G thereon. The appearance of one or more surfaces of the lighting modules 106A-106G may be modified by anodizing, coating, and/or painting. The lighting modules 106A-106G could be of different types and/or sizes (e.g., lengths, heights, etc.), depending on user preferences or space limitations. Each lighting module 106A-106G may embody or include at least one light fixture 110A-110B, which may include the same or different types in a single lighting apparatus. For example, lighting modules 106A-106G may include a linear light fixture 110A (with a lens or diffuser 624 extending along a bottom thereof), a track-type spotlight fixture 110B, and/or any other type of light fixture disclosed herein. In certain embodiments, for example, a lighting apparatus 102 may include a raceway element 104 supporting one lighting module 106B incorporating a linear light fixture 110A and another lighting module 106C incorporating a track-type spotlight fixture 110B. In other embodiments, for example, a lighting apparatus 102 may include a raceway element 104 with first and second lighting modules 106B, 106D each incorporating a linear light fixture 110A. In other embodiments, a lighting apparatus 102 may include, for example, a raceway element 104 receiving a lighting module 106A-106G incorporating only a single linear light fixture 110A or a single track-type spotlight fixture 110B. In such embodiments, if one or more components (e.g., a driver or emitter) of a particular lighting module 106A-106G should fail, then the lighting module 106A-106G can be replaced without requiring replacement of the raceway element 104.

Referring to FIG. 1B, each lighting module 106A-106G is configured to be mechanically and electrically connected to a raceway element 104 in a manner such that the lighting module 106A-106G may be readily removed from the raceway element 104, and interchangeably positioned (or re-positioned) along a length the raceway element 104. For example, a linear light fixture 110A may be replaced with a track-type spotlight fixture 110B using the same raceway element 104 (e.g., without replacing the raceway element 104). Further, as another example, a lighting module 106C with a track-type spotlight fixture 110B can be moved from a first location on the raceway element 104 to a second location on the raceway element 104, where the first location may overlap with the second location. For example, a lighting module 106C incorporating the track-type spotlight fixture 110B may be removed to create a first unoccupied space, an adjacent module 106B incorporating the linear light fixture 110A may be moved to the first unoccupied space (e.g., by removing and reattaching, sliding, etc.) to create a second unoccupied space at the other end of the linear light fixture 110A, and the lighting module 106C incorporating the track-type spotlight fixture 110B may be reattached to the raceway element 104 at the second unoccupied space. Further, in certain embodiments, for example, a lighting module 106B (e.g., incorporating a linear light fixture 110A) may extend across (e.g., straddle) two different (e.g., collinearly arranged) raceway elements 104, with such raceway elements 104 preferably being mechanically and electrically coupled to one another.

Regarding a lighting module 106C with track-type spotlight fixtures 110B, the lighting module 106C is positionable along a length of the raceway element 104 (e.g., the lighting module can be moved relative to the raceway element 104), as discussed above. Further, the track-type spotlight fixtures 110B may be positionable along a length of the lighting module 106C. In particular, the lighting module 106C may include a housing 220 for attachment of the light module 106C to the raceway 104, and a track attachment 802 arranged along a bottom of the housing 220 for positioning of the track-type spotlight fixtures 110B relative to the housing 116. As explained in more detail below, the track-type spotlight fixtures 110B may be at least partially retained in and positionable along a length of the track attachment 802.

The lighting modules 106A-106G are configured to be mechanically attached to and detached from their respective raceway element 104 by translation (e.g., vertical translation) therebetween. Preferably, the lighting modules 106 are non-rotatable relative to the raceway element 104 following insertion and attachment via vertical translation. Linear light fixtures 110A may include a driver positioned within a housing 220 of the light fixture, while track-type spotlight fixtures 110B may be configured to have a driver positioned within a base 814 of the track-type spotlight fixtures 110B, as explained in more detail below.

Accordingly, the modular lighting system 100 provides increased modularity in combination with reduced complexity, cost, and/or time required for installation, servicing, replacement, and/or reconfiguration. In certain embodiments, raceway sections can be installed in long runs, around corners, in crossing configurations, in split runs, etc. As compared to conventional lighting systems, modules of lighting systems disclosed herein may be individually removed and replaced without removal of ceiling-mounted elements (e.g., a raceway) and/or removal of other modules, preferably with minimal use of tools, and modules may be repositioned at any desired locations without requiring placement at specific locations corresponding to immovable electric plugs or electrical receptacles. In certain embodiments, lighting modules may be removed and replaced without requiring individual wiring (or re-rewiring) of each lighting module 106 to one another. Moreover, a modular lighting system 100 may provide clean uninterrupted runs of lighting apparatuses 102.

Figure 2A:
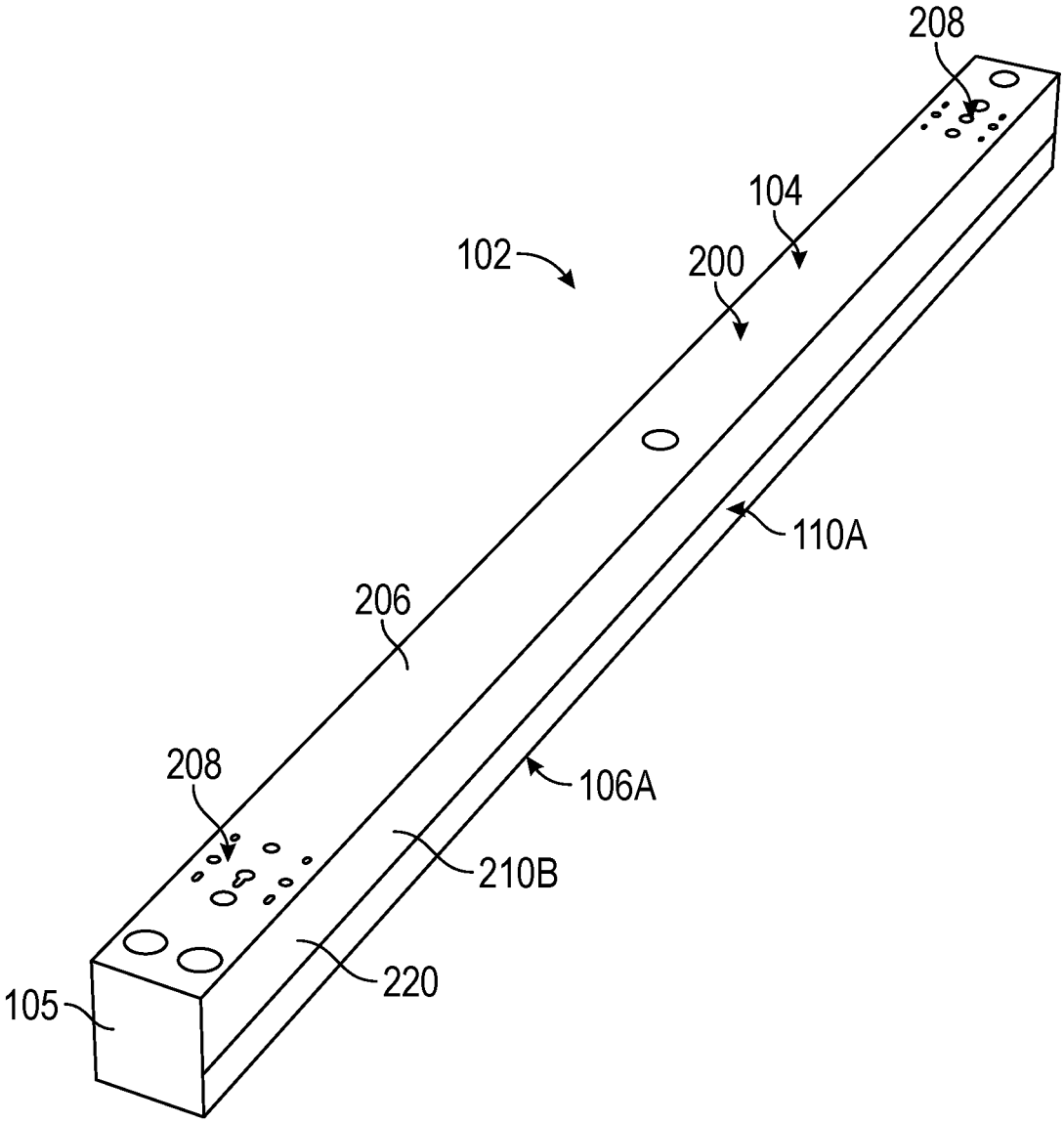
FIG. 2A is an upper perspective view of a lighting apparatus including a ceiling-mountable raceway element supporting an elongated linear lighting module.
Figure 2B:
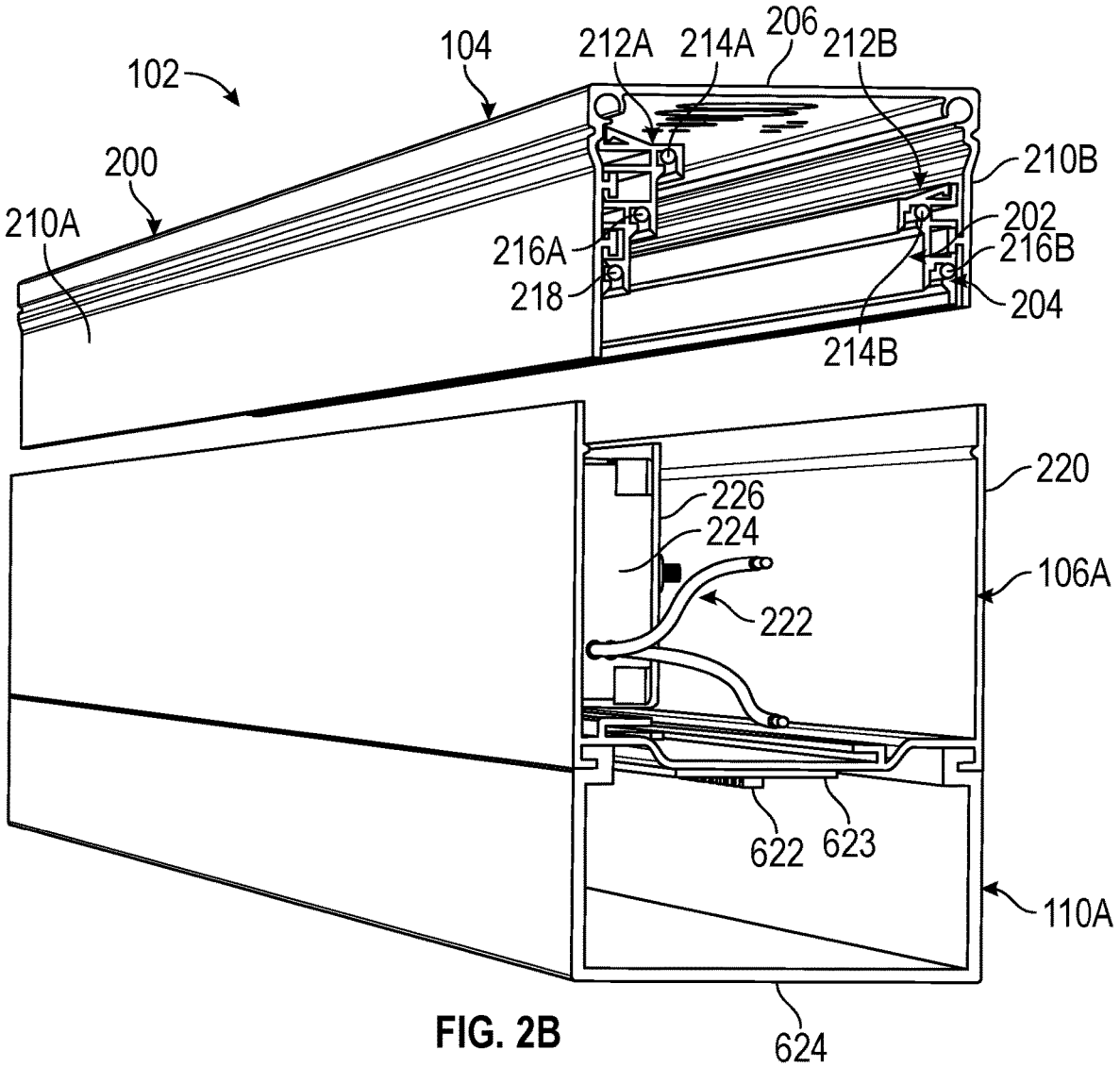
FIG. 2B is a perspective view of the lighting apparatus of FIG. 2A, illustrating separation of the lighting module from the raceway element.
Figure 2C:
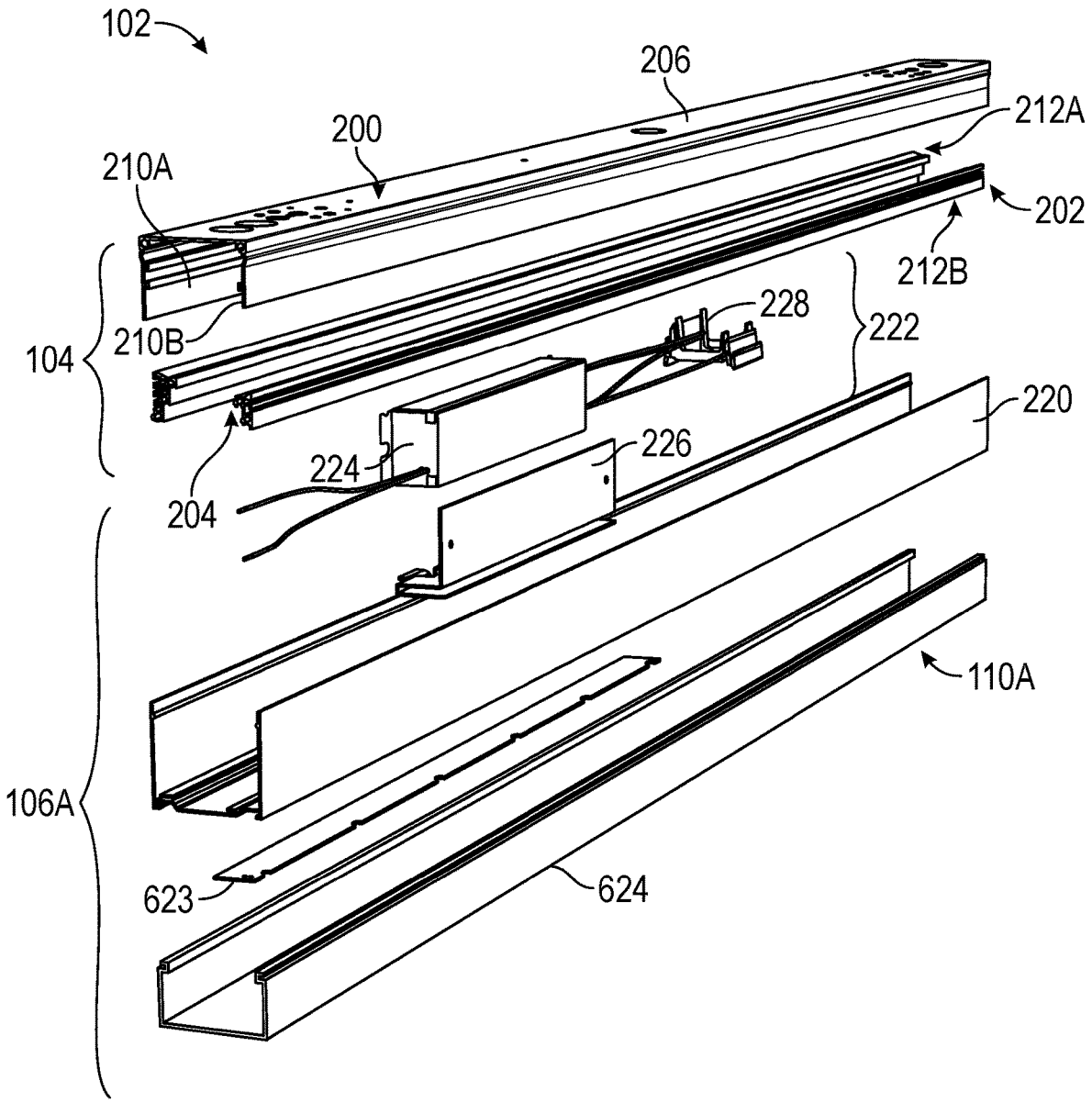
FIG. 2C is an exploded view of the lighting apparatus of FIGS. 2A and 2B.

FIGS. 2A-2C are views of at least a portion of a lighting apparatus 102 including at least a portion of a raceway element 104 and a lighting module 106 incorporating a linear light fixture 110A of a type as shown in FIGS. 1A and 1B. The lighting module 106A is removably attachable to the raceway element 104. In certain embodiments, the lighting module 106A is attachable and/or detachable from the raceway element 104 by translation (e.g., vertical translation, or substantially vertical translation) of the lighting module 106A relative to the raceway element 104. In certain embodiments, both mechanical and electrical connection is accomplished by vertical translation, without requiring rotation between the lighting module 106A and the raceway element 104. The lack of need for rotation between the lighting module 106A and the raceway element 104 to provide mechanical and/or electrical connections therebetween embodies merely one distinction between the lighting apparatus 102 and conventional track lighting systems. Following attachment via vertical translation, at least a portion (e.g., a housing 220) of the lighting module 106A is non-rotatable relative to the raceway element 104.

As noted previously herein, the raceway element 104 provides structural support and electrical connection, to the lighting module 106A. The raceway element 104 includes a raceway body 200, at least one insulating element 202 (e.g., shown in FIGS. 2B and 2C and embodied in extruded inserts 212A, 212B) positioned within the raceway body 200, and a plurality of electrical conductors 204 positioned within the raceway body 200 and mounted within the at least one insulating element 202.

The raceway body 200 includes an upper raceway wall 206 (e.g., top wall member) with a plurality of holes 208 for flush mounting of the raceway element 104 to a ceiling. In particular, the raceway element 104 may be mounted to a ceiling using one or more fasteners (e.g., screws) inserted through the plurality of holes 208 into the ceiling. The raceway body 200 further includes a left raceway wall 210A (e.g., left wall member; shown in FIGS. 2B and 2C) extending from a left edge of the upper raceway wall 206. The raceway body 200 further includes a right raceway wall 210B (e.g., right wall member) extending from a right edge of the upper raceway wall 206 opposite from the left raceway wall 210A. Each raceway wall 210A, 210B includes a distal (or outer) surface that opposes a medial (or inner) surface.

As shown in FIG. 2A, one or more endcaps 105 may be provided at one or more ends of the lighting apparatus 102, such as may be useful to enclose ends of a raceway element 104 and one or more lighting modules 106A-106G. The endcaps 105 may be omitted where multiple lighting raceway elements 104 are connected with one another, such as with corner-type, T-type, or X-type raceway connectors (not shown).

In certain embodiments, the at least one insulating element 202 includes a left and right extruded inserts 212A, 212B (shown in FIGS. 2B and 2C) mounted to medial surfaces of the left raceway wall 210A and the right raceway wall 210B, respectively. The extruded inserts 212A, 212B electrical isolate electrical conductors 204 from one another and from adjacent raceway walls 210A, 210B to which the extruded inserts 212A, 212B are mounted.

As shown in FIG. 2B, a plurality of electrical conductors 204 (optionally referred to herein as raceway conductors) may be embodied in wires, ribbons, or other configurations of any suitable shape. The plurality of electrical conductors 204 may include a left upper raceway conductor 214A, a left lower raceway conductor 216A (e.g., wire), and a grounding conductor 218 (e.g., wire) mounted in the left extruded insert 212A. The plurality of electrical conductors 204 further includes a right upper raceway conductor 214B (e.g., wire, second raceway conductor) and a right lower raceway conductor 216B.

The plurality of electrical conductors 204 is configured to supply power to the lighting module 106A, as well as any additional lighting modules (not shown) received by the raceway element 104. The lighting module 106A includes a housing 220, an electrical interconnect structure 222 (shown in FIGS. 2B and 2C) mounted within the housing 220, and a linear light fixture 110A mounted along a lower portion of the housing 220. As explained in more detail below, the electrical interconnect structure 222 is in electrical communication with the plurality of electrical conductors 204 of the raceway element 104, and also is in electrical communication with the linear light fixture 110A.

As shown in FIGS. 2B and 2C, the electrical interconnect structure 222 includes a driver 224 mounted to an interior of the housing 220 by a bracket mount 226. The electrical interconnect structure 222 further includes an electrical connector 228 (shown in FIG. 2C) in electrical communication with the driver 224 and selectively attachable to the raceway element 104.

As further shown in FIGS. 2B and 2C, the lighting module 106A includes at least one emitter support plate 623 arranged to support multiple LEDs 622 and mounted to a lower surface of the housing 220. Light generated by the LEDs 622 is emitted downward through a lens or diffuser 624 to exit the lighting module 106A.

Figure 3:
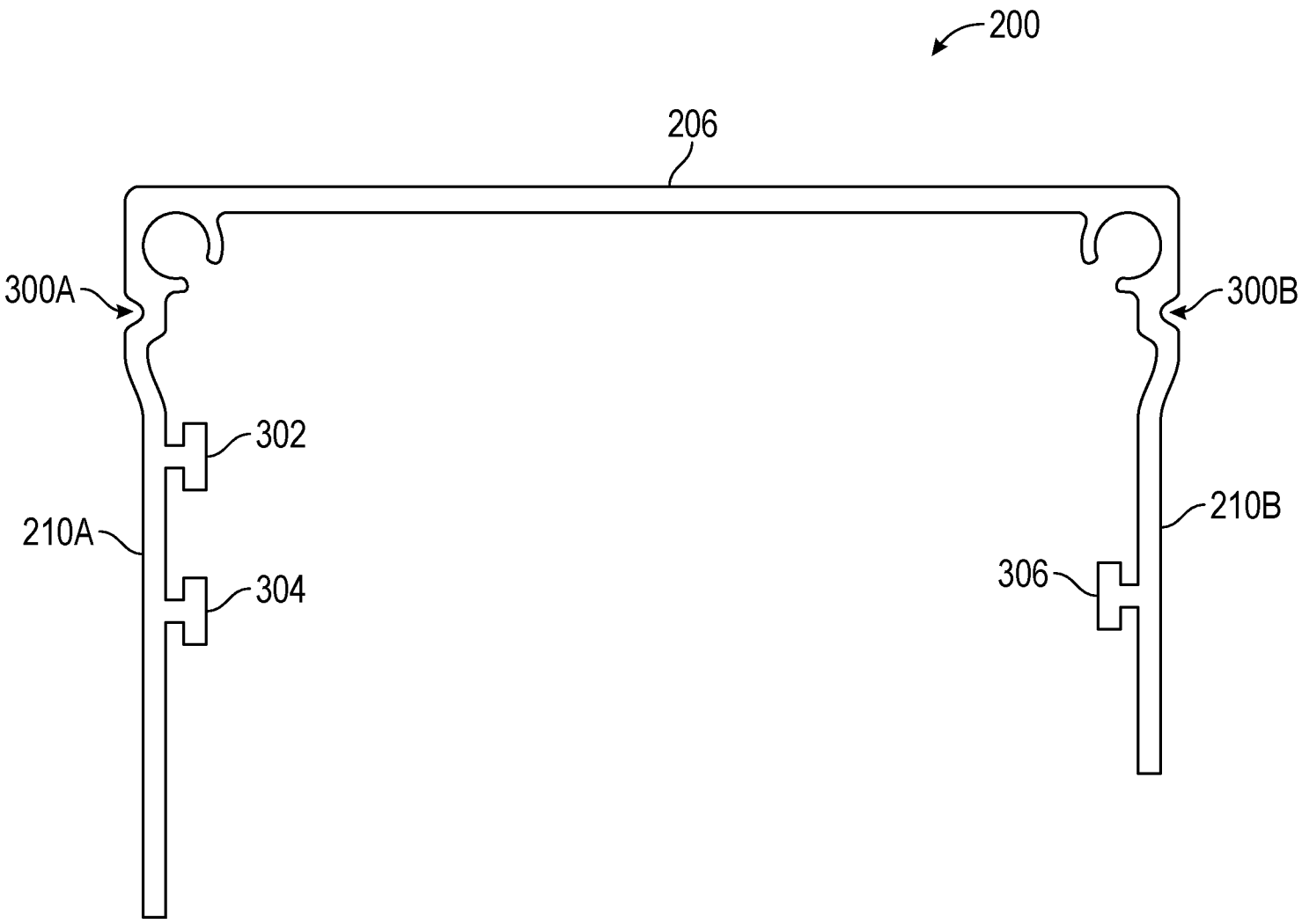
FIG. 3 is a cross-sectional view of a raceway body of the raceway element of the lighting apparatus of FIGS. 1A-2C.

FIG. 3 is a cross-sectional view of the raceway body 200 of the raceway element 104 of FIGS. 2A-2C. The raceway body 200 includes opposing left and right raceway walls 210A, 210B. The raceway body 200 includes a mechanical coupling structure (e.g., embodied as one or more grooves or lips) configured to mate with corresponding mechanical coupling structure (e.g., one or more lips or grooves) of a housing of a lighting module, such as the housing 220 shown in FIGS. 2B and 2C. In particular, the left raceway wall 210A includes a left distal longitudinal groove 300A (embodied in a groove defined in a distal surface of the left raceway wall 210A), parallel to and proximate to the upper raceway wall 206. The right raceway wall 210B similarly includes a right distal longitudinal groove 300B (embodied in a groove defined in in a distal surface of the right raceway wall 210B) parallel to and proximate to the upper raceway wall 206. The left and right distal longitudinal grooves 300A, 300B extend between longitudinal ends of the raceway body 200. The left and right distal longitudinal grooves 300A, 300B are preferably continuous in character to facilitate variable positioning (e.g., continuously variable positioning) of the lighting module 106A relative to the raceway element 104. Preferably, the lighting module 106A may be positioned at substantially any point along the left and right distal longitudinal grooves 300A, 300B). In certain embodiments, the left and right raceway walls 210A, 210B include a distal lip (not shown) instead of, or in addition to, the left and right distal longitudinal grooves 300A, 300B, to mate with a corresponding groove (not shown) defined in walls of a module housing.

In certain embodiments, medial surfaces of the left and right raceway walls 210A, 210B include one or more longitudinal rails configured to retain at least one insulating element such as extruded inserts 212A, 212B as shown in FIGS. 2B and 2C. The left raceway wall 210A further includes a left upper rail 302 and a left lower rail 304, where the left upper rail 302 is positioned above the left lower rail 304. The left upper rail 302 is positioned proximate to the upper raceway wall 206. The right raceway wall 210B further includes a right rail 306. The left upper rail 302, left lower rail 304, and/or right rail 306 extend in a longitudinal direction between respective longitudinal ends of the raceway body 200.

Figure 4B:
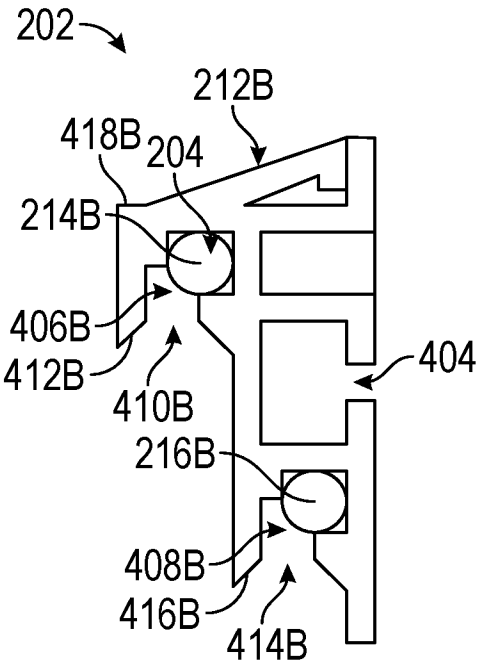
FIG. 4B is a cross-sectional view of a right extruded insert of an insulating element of the lighting apparatus of FIGS. 1A-2C.
Figure 4A:
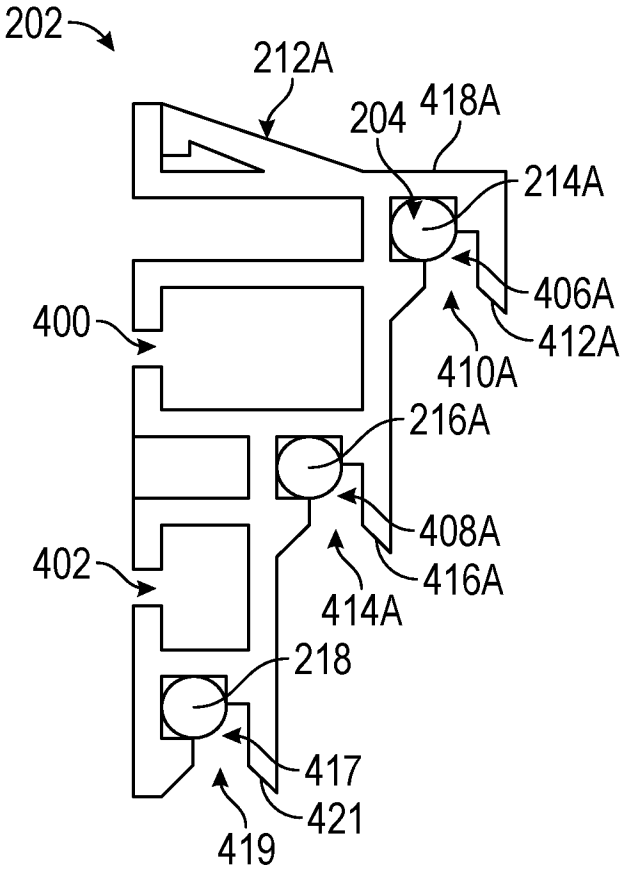
FIG. 4A is a cross-sectional view of a left extruded insert of an insulating element of the lighting apparatus of FIGS. 1A-2C.

FIGS. 4A and 4B are cross-sectional views of the left extruded insert 212A and the right extruded insert 212B of the insulating element 202 of FIGS. 1A-2C, respectively. Each of the left extruded insert 212A and the right extruded insert 212B extends substantially an entire length of the raceway body 200. Each of the left and right extruded inserts 212A, 212B is configured to receive multiple electrical conductors of the plurality of electrical conductors 204 therein, including conductors 214A, 216A, 218 retained by the left extruded insert 212A, and conductors 214B, 216B retained by the right extruded insert 212B.

The left extruded insert 212A comprises a left upper track 400 and a left lower track 402 that are configured to slidably receive therein the left upper rail 302 and the left lower rail 304, respectively, of the left raceway wall 210A (shown in FIG. 3). Similarly, the right extruded insert 212B includes a right track 404 that is configured to slidably receive the right rail 306 therein. In this manner, the left extruded insert 212A and the right extruded insert 212B may be mounted to a medial inner surfaces of the left raceway wall 210A and the right raceway wall 210B, respectively, of the raceway body 200 (shown in FIG. 3). The left and right extruded inserts 212A, 212B are shown as separate from one another, but in other embodiments, the left and right extruded inserts 212A, 212B may be attached to, or integrally formed with, one another (e.g., by a transverse support (not shown) spanning across the raceway body 200 proximate to the upper raceway wall 206).

As shown in FIG. 4A, the left extruded insert 212A includes an upper channel 406A, a lower channel 408A, and a grounding channel 417, with each of the foregoing channels 406A, 408A, 417 being horizontally and vertically offset from one another. Each channel 406A, 408A, 417 defines a bottom opening 410A, 414A, 419 (arranged between tapered surfaces 412A, 416A, 421, such that each channel 406A, 408A, 417 is devoid of a lower boundary. The bottom openings 410A, 414A, 419 of the channels 406A, 408A, 417 provide access for receiving electrical contacts arranged atop ridges an electrical connector of the lighting module 106A (e.g., as shown in FIG. 5B), with the tapered surfaces 412A, 416A, 421 guiding insertion of the electrical contacts. The left extruded insert 212A additionally includes a mechanical engagement feature embodied as a shoulder 418A, to permit the left extruded insert 212A to retain an electrical connector.

As shown in FIG. 4B, the right extruded insert 212B includes an upper channel 406B and a lower channel 408B that is horizontally and vertically offset from the upper channel 406B. Each channel 406B, 408B defines a bottom opening 410B, 414B arranged between tapered surfaces 412B, 416B (e.g., the medial upper channel 406B is devoid of a lower boundary) with a longitudinal taper 412B. The bottom openings 410B, 414B of the channels 406B, 408B provide access for receiving electrical contacts arranged atop ridges of an electrical connector of the lighting module 106A, with the tapered surfaces 412B, 416B guiding insertion of the electrical contacts. The right extruded insert 212B further includes a mechanical engagement feature embodied as a shoulder 418B, to permit the right extruded insert 212B to retain an electrical connector.

The upper channels 406A, 406B, the lower channels 408A, 408B, and/or the grounding channel 417 may be devoid of a lower boundary for at least a portion or an entirety of a length thereof, such as between 5%-100% (e.g., 25%, 50%, 75%, 100%, etc.). Accordingly, lower surfaces of the left and right upper raceway conductors 214A, 214B, the left and right lower electrical conductors 216A, 216B, and/or the grounding conductor 218 (which are mounted in the medial upper channels 406A, 406B, the medial lower channels 408A, 408B, and/or the grounding channel 417) are exposed for a length thereof, such as between 5%-100% (e.g., 25%, 50%, 75%, 100%, etc.).

Figure 5A:
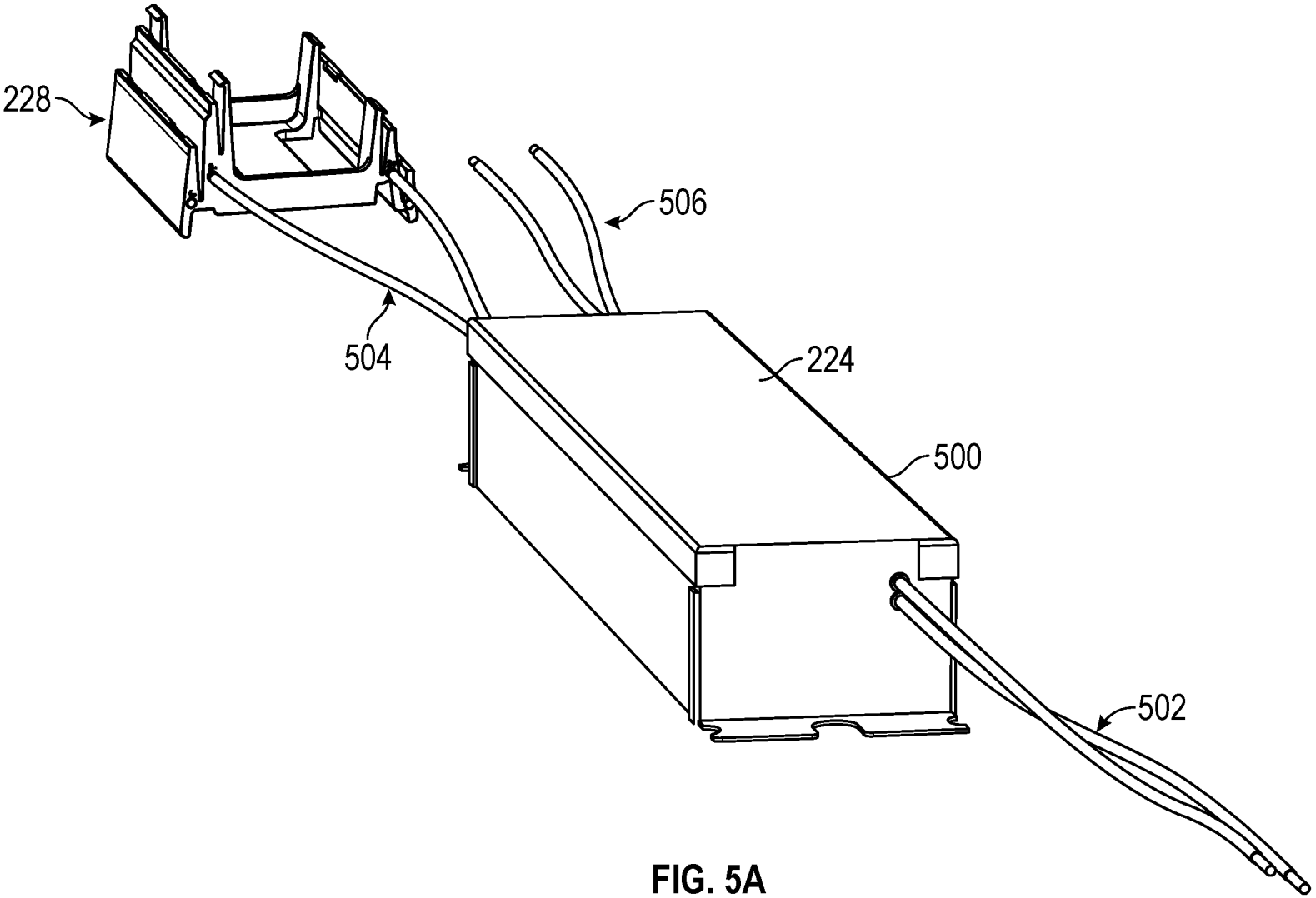
FIG. 5A is a perspective view of an electrical connector and a driver useable with the lighting apparatus of FIGS. 1A-2C.
Figure 5B:
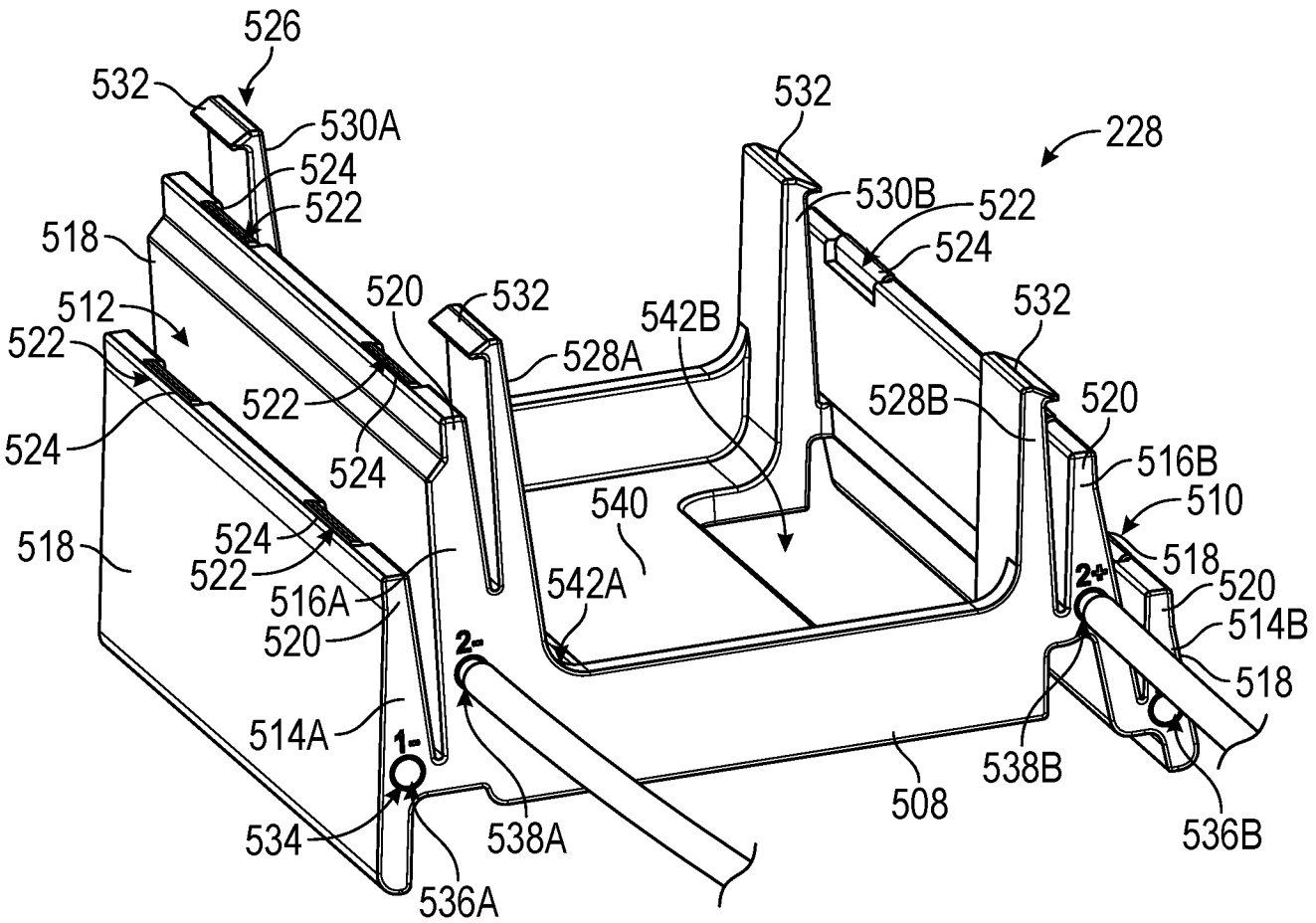
FIG. 5B is a perspective view of the electrical connector of FIG. 5A.

FIG. 5A is a perspective view of an electrical connector 228 and a driver 224 useable with one or more lighting apparatuses 102 of FIGS. 1A-2C. The driver 224 includes a housing 500 with a plurality of wire pairs. In particular, the driver 224 includes a first (light fixture) wire pair 502 extending from a front surface of the driver 224 and intended for coupling with a linear light fixture 110A (not shown in FIG. 5A). The driver 224 further includes second and third wire pairs 504, 506 extending from a rear surface of the driver 224 and intended for coupling with the electrical connector 228. In certain embodiments, the second and third wire pairs 504, 506 are removably connectable with the electrical connector 228 to enable a light fixture coupled with the driver to be selectively connected to different pairs of conductors of a raceway element, thereby enabling the light fixture to be operated by first or second different electrical circuits operatively coupled to the raceway element.

FIG. 5B is a perspective view of the electrical connector 228 of FIG. 5A. The electrical connector 228 includes a base portion 508 with multiple ridges 514A, 514B, 516A, 516B extending upwardly therefrom, with the multiple ridges 514A, 514B, 516A, 516B defining valleys 512 therebetween and collectively forming an insertion feature 510. In particular, the insertion feature 510 includes a left distal ridge 514A, a left medial ridge 516A, a right distal ridge 514B, and a right medial ridge 516B, and tops of the ridges 514A, 514B, 516A, 516B are horizontally and vertically offset from one another. The insertion feature 510 extends (approximately) from a front to a rear of the base portion 508. Each ridge 514A, 514B, 516A, 516B may include sidewalls 518 that taper to a narrowed tip 520, with each narrowed tip 520 defining one or more openings 522 therein, and with electrical contacts 524 being at least partially exposed through the openings 522. When the insertion feature 510 is inserted into a raceway element 104 (e.g., as shown in FIG. 2B), the electrical contacts 524 can establish conductive electrical communication with the electrical conductors positioned within the raceway element (e.g., conductors within the left and right extruded inserts 212A, 212B of FIGS. 4A and 4B).

With continued reference to FIG. 5B, the electrical connector 228 further includes a mechanical retention feature 526 extending upwardly from the base portion 508. The mechanical retention feature 526 includes left front and right front engagement arms 528A, 528B at or proximate to the front of the base portion 508, and a left rear and right rear engagement arms 530A, 530B at or proximate to the rear of the base portion 508. Each engagement arm 528A, 528B, 530A, 530B includes a prong 532 at a top thereof, and is outwardly biased so that the prongs 532 can engage shoulders of the extruded inserts associated with the raceway element (discussed in more detail below).

The base portion 508 further includes a reconfigurable electrical interface 534 defined in a front end wall of the base portion 508 to permit a driver to be coupled (or recoupled) to different electrical circuits associated with conductors of a raceway element. As shown, the reconfigurable electrical interface 534 includes a left distal terminal 536A defined in a bottom of the left distal ridge 514A, a left medial terminal 538A defined in a bottom of the left medial ridge 516A, a right distal terminal 536B defined in a bottom of the right distal ridge 514B, and a right medial terminal 538B defined in a bottom of the right medial ridge 516B. As shown, each terminal 536A, 536B, 538A, 538B may be internal to, and accessed via an opening defined in, the base portion 508. In alternative embodiments, terminals of any suitable type (screw-type, solder-type, etc.) may be arranged on an external surface of the base portion 508 or any other portion of the electrical connector 228. Each terminal of the reconfigurable electrical interface 534 is in electrical communication (via electrically conductive structures (not shown) internal to the electrical connector 228) with a different corresponding electrical contact 524 atop the ridges 514A, 514B, 516A, 516B. In certain embodiments, each terminal of the reconfigurable electrical interface 534 may include a mechanical securement feature therein to secure a wire of the driver 224 therein. For example, the mechanical securement feature may include spring-loaded cleats (not shown), which may be mechanically releasable.

The base portion 508 includes a bottom wall 540 extending longitudinally from the front to the rear of the base portion 508. The bottom wall 540 defines a left recess 542A between a left side of the bottom wall 540 and a surface or downwardly projecting extension of the left distal ridge 514A and/or the left medial ridge 516A. Similarly, the bottom wall 540 defines a right recess 542B between a right side of the bottom wall 540 and a downwardly projecting extension of the right distal ridge 514B and/or the right medial ridge 516B. Accordingly, the longitudinal bottom wall 540 provides a gripping feature for a user to grab to insert and withdraw the electrical connector 228 from the raceway element 104, where the left and right recesses 542A, 542B provide clearance for a user to grip the bottom wall 540.

Figure 6A:
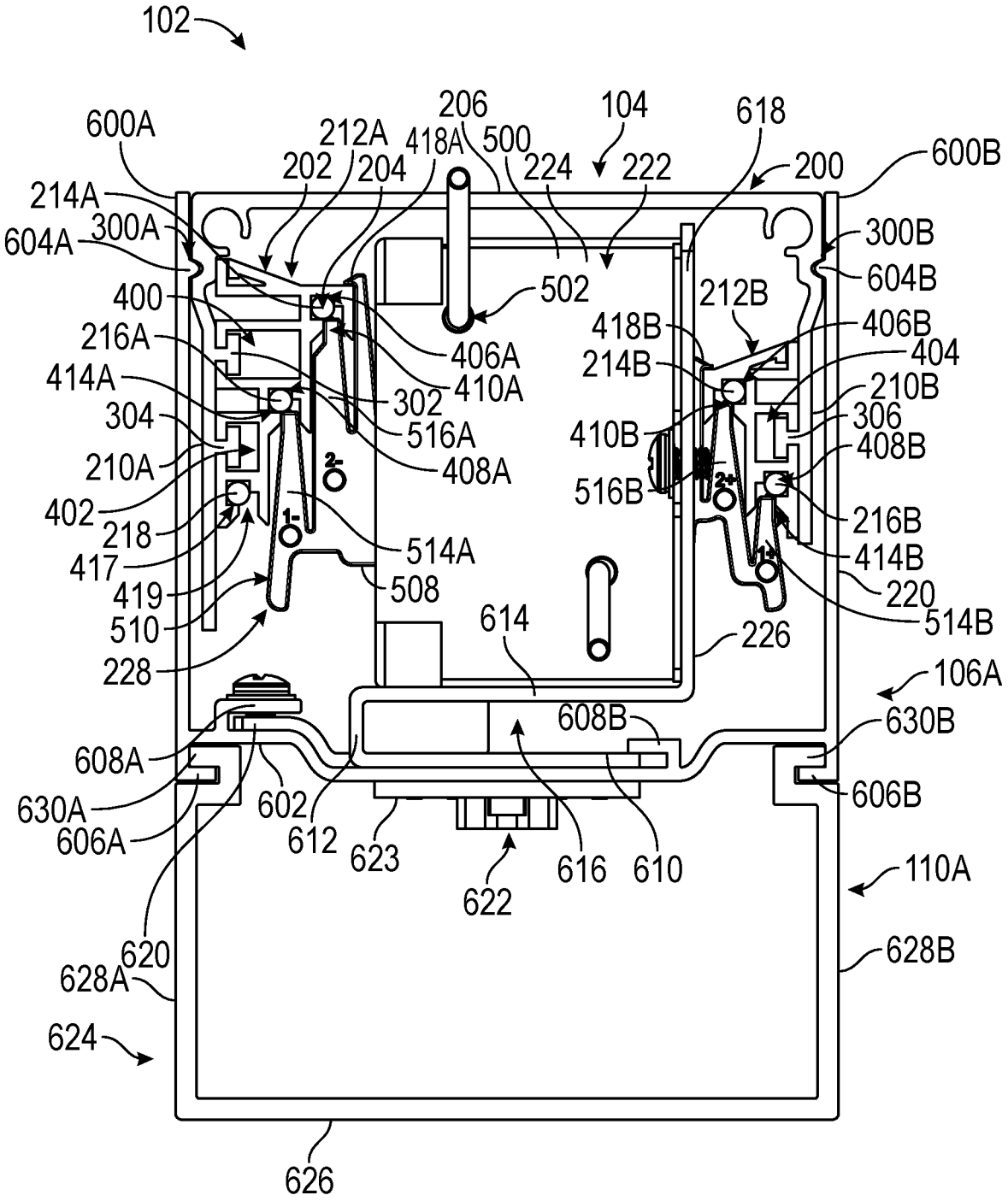
FIG. 6A is a front cross-sectional view of the assembled lighting apparatus of FIGS. 1A-5B.
Figure 6B:
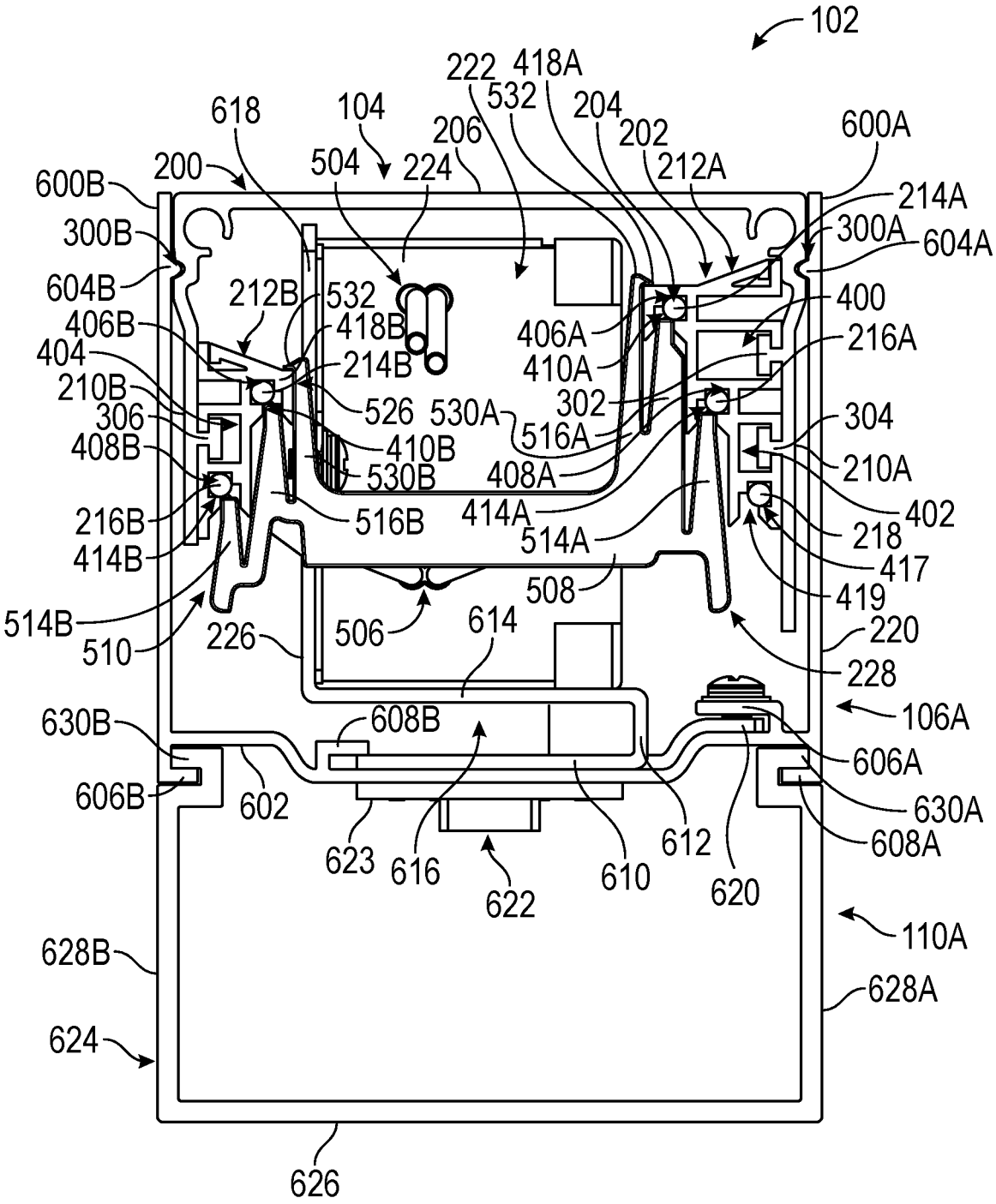
FIG. 6B is a rear cross-sectional view of the assembled lighting apparatus of FIG. 6A.

FIGS. 6A and 6B are cross-sectional views of an assembled lighting apparatus 102 incorporating an elongated linear light fixture 110A according to FIGS. 1-5B. The housing 220 of the lighting module 106A includes opposing left and right housing walls 600A, 600B with a transverse support 602 extending therebetween. The left housing wall 600A includes a left medial engagement lip 604A to engage the left distal longitudinal groove 300A of the left raceway wall 210A. The right housing wall 600B includes a right medial engagement lip 604B to engage the right distal longitudinal groove 300B of the right raceway wall 210B. In certain embodiments, the left and right housing walls 600A, 600B may include grooves in addition to, or instead of, the left and right medial engagement lips 604A, 604B.

The left housing wall 600A includes a left lower mounting flange 606A, and the right housing wall 600B includes a right lower mounting flange 606B. The left and right lower mounting flanges 606A, 606B are configured to engage a linear light fixture 110A (discussed in more detail below). Further, the transverse support 602 comprises a left mounting flange 608A and a right mounting flange 608B to engage the bracket mount 226 to secure the driver 224 to the housing 220.

The bracket mount 226 includes a lower base 610, a lower sidewall 612 upwardly extending from an edge of the lower base 610, and an upper base 614 extending from a top of the lower sidewall 612. The upper base 614 positioned over and substantially parallel to the lower base 610, with an air gap 616 defined between the upper base 614 and the lower base 610. The bracket mount 226 further comprises a driver mounting sidewall 618 extending upwardly from the upper base 614 at a side opposite from the lower sidewall 612. The driver 224 is secured to the driver mounting sidewall 618 by fasteners (e.g., screws, nuts, etc.). The air gap 616 reduces conductive heat transfer between light emitting diodes (LEDs) 622 (mounted to a bottom of the housing 220) and the driver 224, thereby reducing the likelihood of overheating of the driver 224 and/or the LEDs 622. The bracket mount 226 further includes mounting tabs 620 to mount the bracket mount 226 to the housing 220.

The light fixture 110A shown in FIGS. 6A and 6B is a linear light fixture 110A including an array of light emitting diodes (LEDs) 622 mounted to a LED support plate 623 affixed to a bottom surface of the transverse support 602 of the housing 220. The LEDs 622 are electrically connected with the driver 224, which is configured to control operation of the LEDs 622. In certain embodiments, the LEDs 622 are configured to emit white light.

The linear light fixture 110A further includes a lens or diffuser 624 that includes a bottom wall 626, an opposing left and right sidewalls 628A, 628B that extend upwardly from the bottom wall 626. The left sidewall 628A includes a left distal flange 630A and the right sidewall 628B includes a right distal flange 630B. The left and right distal flanges 630A, 630B are complementary to and engage the left and right lower mounting flanges 606A, 606B of the left and right housing walls 600A, 600B of the housing 220. The left and right sidewalls 628A, 628B may be outwardly biased such that pivoting a top of the left and right sidewalls 628A, 628B may disengage the left and right distal flanges 630A, 630B from the left and right lower mounting flanges 606A, 606B, thereby disengaging the lens or diffuser 624 from the housing 220. The lens or diffuser 624 may be disengaged from the housing 220 by translating (e.g., sliding) and/or flexing the lens or diffuser 624 relative to the housing 220.

As illustrated in FIGS. 6A and 6B, the LEDs 622 are positioned between the housing 220 and the lens or diffuser 624. The bottom wall 626 and/or the sidewalls 628A, 628B are preferably transmissive of one or more wavelengths of light generated by the LEDs 622 to enable light emissions to be transmitted from the lighting module 106A.

Figure 6C:
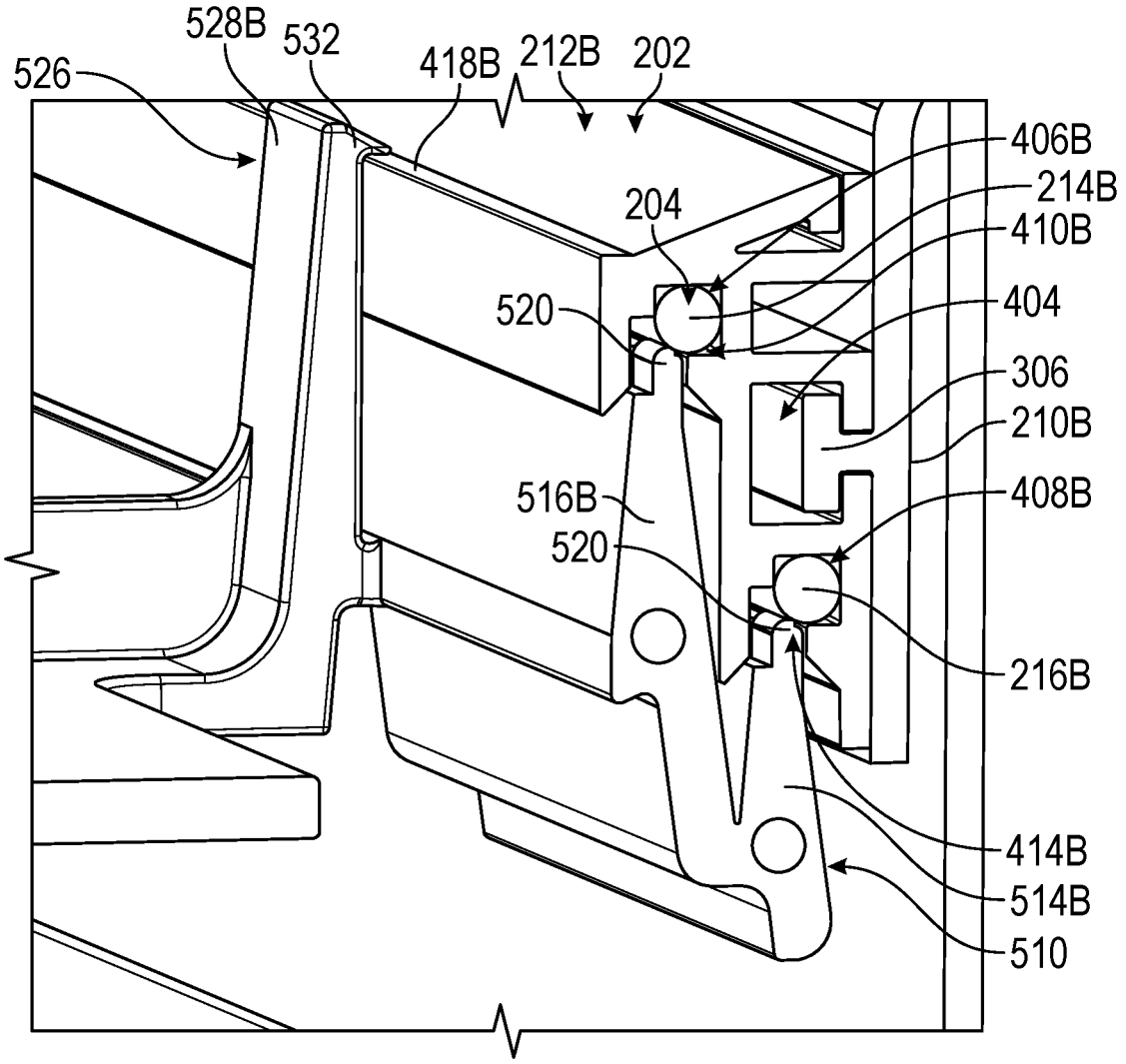
FIG. 6C is a cross-sectional perspective view of a portion of the assembled lighting apparatus of FIGS. 6A and 6B, illustrating connection between the electrical connector and the raceway element.

FIG. 6C is a magnified perspective cross-sectional view of a portion of the assembled lighting apparatus of FIGS. 6A and 6B, and illustrates connection between the electrical connector 228 and the raceway element 104. As shown, when the electrical connector 228 is inserted into raceway element 104 to be received by the extruded inserts 212A, 212B of the insulating element 202, the insertion feature 510 (encompassing multiple ridges) of the electrical connector 228 is inserted into the channels of the extruded inserts 212A, 212B. In particular, the left distal ridge 514A is inserted into the lower channel 408A, the left medial ridge 516A is inserted into the upper channel 406A, the right distal ridge 514B is inserted into the lower channel 408B, and the right medial ridge 516B is inserted into the upper channel 406B. Accordingly, the electrical contacts 524 associated with the respective ridges 514A, 514B, 516A, 516B make electrical contact with the left and right upper raceway conductors 214A, 214B and the left and right lower electrical conductors 216A, 216B. Upper portions of the ridges 514A, 514B, 516A, 516B interact with the tapered surfaces 412A, 412B, 416A, 416B to facilitate insertion and engagement of the electrical connector 228.

Figure 7A:
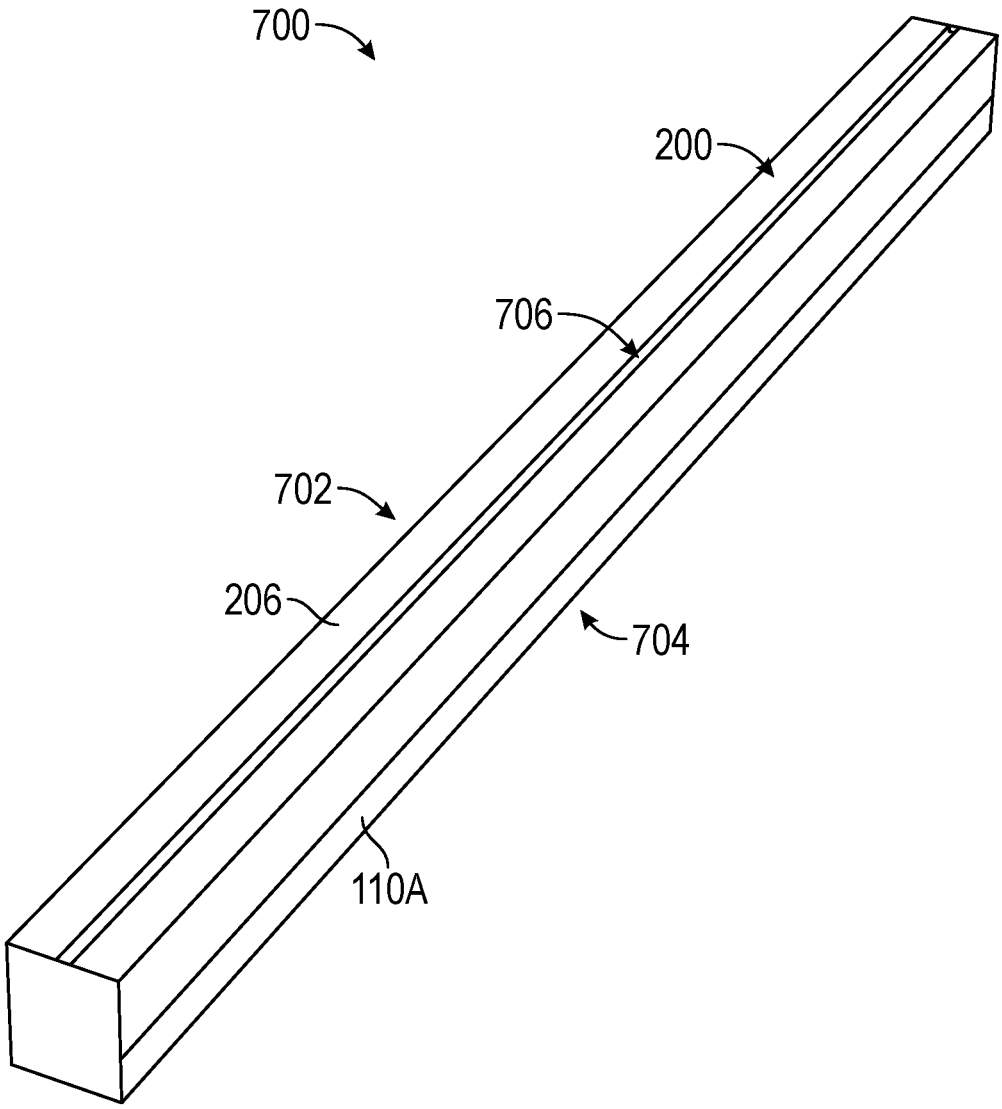
FIG. 7A is an upper perspective view of a lighting apparatus including a raceway element that is suspendable from a ceiling and that is supporting an elongated linear lighting module.
Figure 7B:
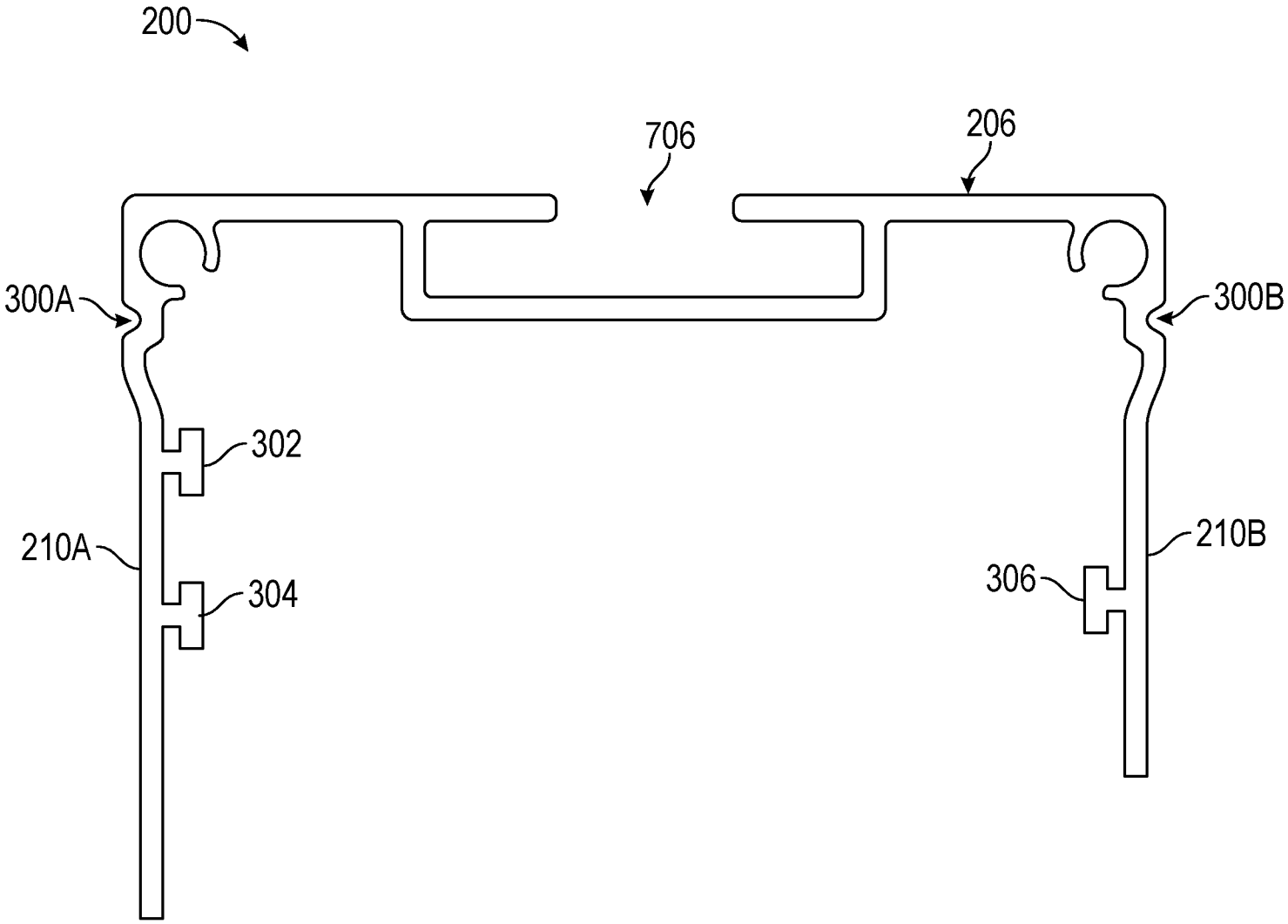
FIG. 7B is a cross-sectional view of the raceway element of the lighting apparatus of FIG. 7A.
Figure 8:
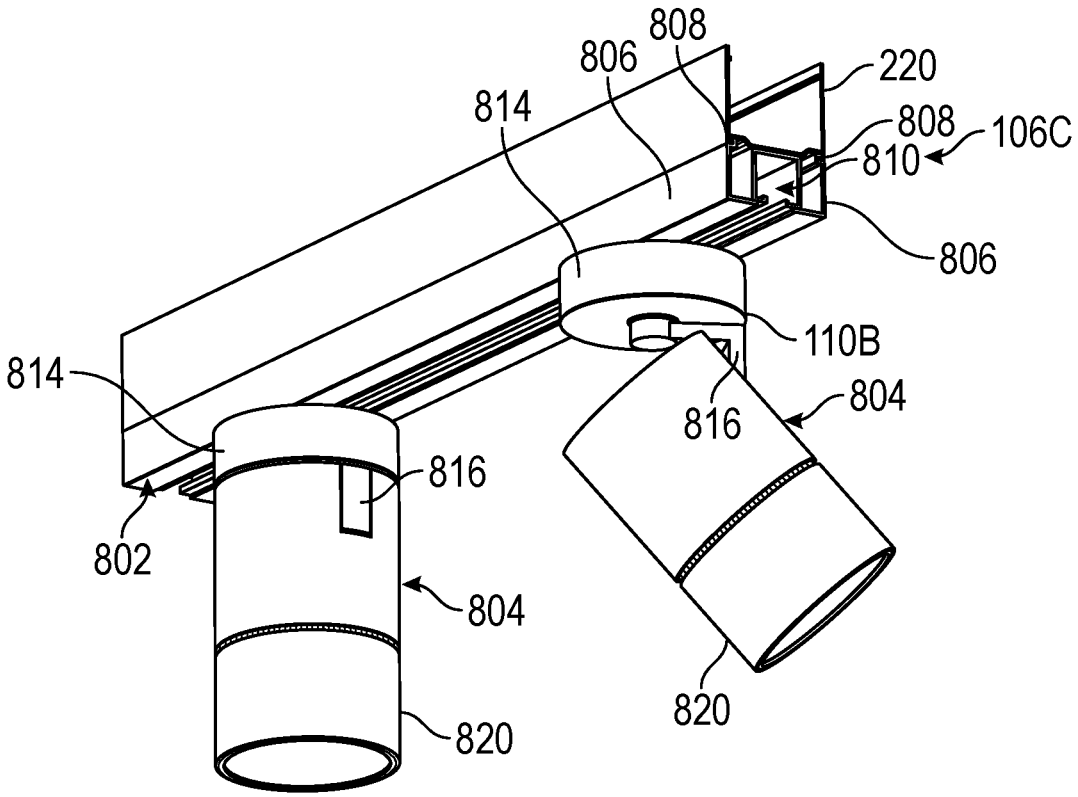
FIG. 8 is a perspective view of the lighting module with the spotlight fixture of FIGS. 1A and 1B.

Various elements shown that have been described hereinabove in connection with prior figures are not described again with respect to FIGS. 6A-6C. FIG. 7A illustrates lighting apparatus 700 including a raceway element 702 that is suspendable from a ceiling and that is supporting an elongated linear lighting module 704, and FIG. 7B provides a cross-sectional view of the raceway element 702 The raceway element 702 includes the same features as the raceway element 104 except where otherwise noted. In particular, the upper raceway wall 206 of the raceway element 702 includes a longitudinal channel 706 defined in an exterior surface of the upper raceway wall 206 to enable the raceway element 702 to be suspended from a ceiling using cables, chains, or the like FIG. 8 is a perspective view of a track-type lighting module 106C with two track-type spotlight fixtures 110B, as previously illustrated in FIGS. 1A and 1B. The module 106C includes a housing 220, a track attachment 802 supported by the housing 220, and two spotlight fixtures 804 engaged to the track attachment 802. It is to be recognized that one or both of the track-type spotlight fixtures 110B may be replaced with track-type fixtures of any suitable type, such as floodlights, pendant lights, or the like. The track attachment 802 includes distal sidewalls 806 with a distal flange 808 defined at a top thereof, wherein the distal flange 808 is configured to engage the lower mounting flanges 606A, 606B of the housing 220. In this way, the same housing 220 may be used to mount different types of lighting modules (e.g., a module embodying linear light fixture 110A or a module including at least one track-type spotlight fixture 110B).

Each of the two spotlight fixtures 804 includes a base 814, an arm 816 extending downwardly from the base 814, and a lighting body 820 at an end of the arm 816 opposite the base 814. The base 814 of each spotlight fixture 804 is slidably attached to the track attachment 802 such that each spotlight fixture 804 can be repositioned within a central channel 810. Each base 814 may additionally include a driver in electrical communication with electrical conductors 204 of the raceway element 104 (similar to the driver 224 associated with a linear light fixture as discussed above).

For each spotlight fixture 804, the arm 816 may be rotatably or fixedly attached to the base 814, allowing the spotlight body 820 to rotate in a first direction. Further, the spotlight body 820 is pivotally attached to the arm 816, allowing the spotlight body 820 to rotate in a second direction.

Figure 9:
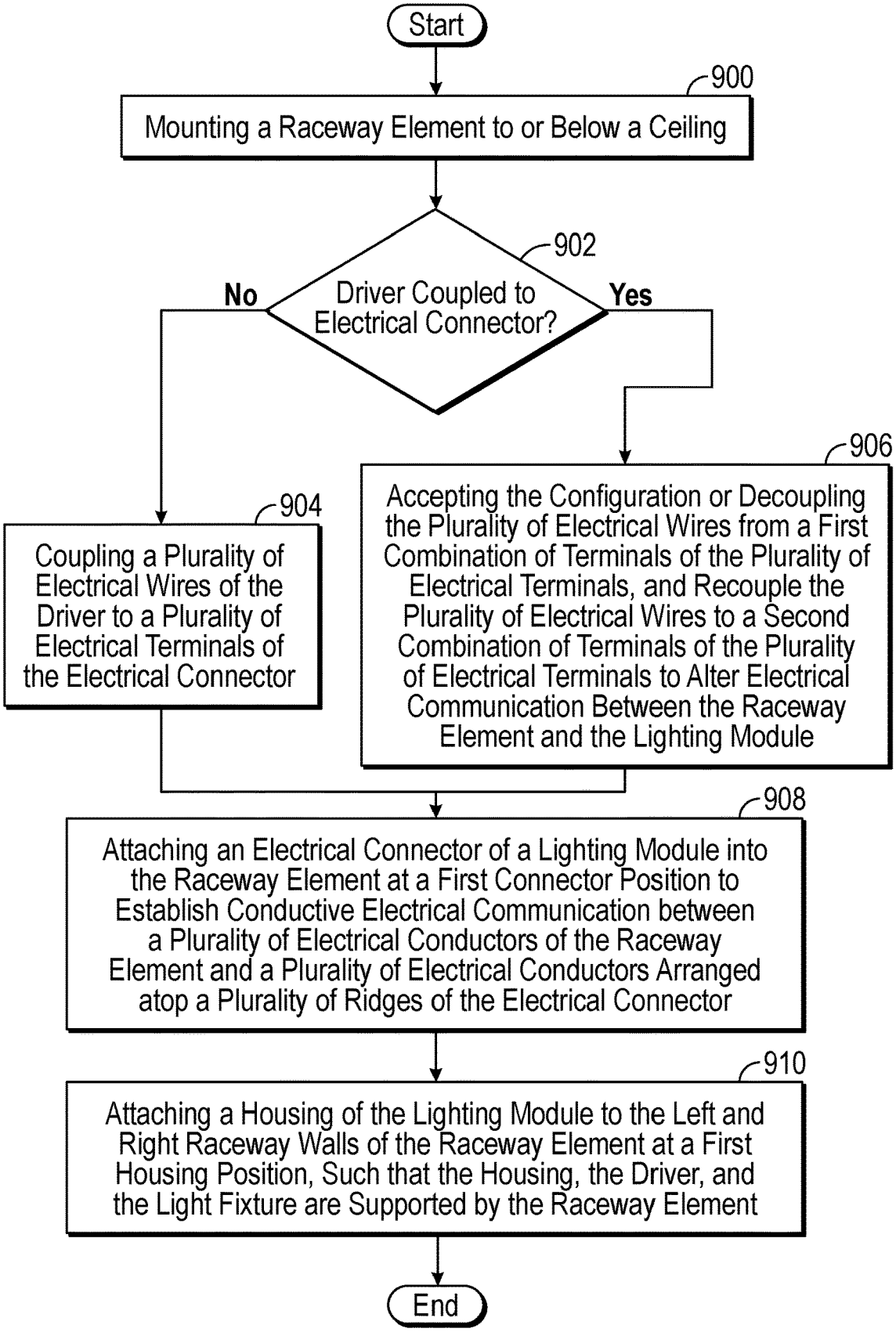
FIG. 9 is a flowchart illustrating steps for fabricating a modular lighting system as disclosed herein.

FIG. 9 is a flowchart illustrating steps for fabricating a modular lighting system as disclosed herein. Step 900 includes mounting a raceway element to or below a ceiling. Step 902 includes making a determination as to whether the driver 224 is coupled to the electrical connector 228. If the driver 224 is not coupled, then step 904 includes coupling a plurality of electrical wires 504, 506 of the driver 224 to a plurality of electrical terminals 536A, 536B, 538A, 538B of the electrical connector 228. If the driver 224 is coupled, then step 906 includes accepting the configuration or decoupling the plurality of electrical wires 504, 506 from a first combination of terminals of the plurality of electrical terminals 534, and recoupling the plurality of electrical wires 504, 506 to a second combination of terminals of the plurality of electrical terminals 534 to alter electrical communication between the raceway element 104 and the lighting module 106A-106G. Step 908 includes attaching an electrical connector 228 of a lighting module 106A-106G into the raceway element 104 at a first connector position to establish conductive electrical communication between a plurality of electrical conductors 204 of the raceway element 104 and a plurality of electrical conductors 204 arranged atop a plurality of ridges 514A, 514B, 516A, 516B of the electrical connector 228, wherein the electrical connector 228 is electrically coupled with a driver 224 electrically coupled with a light fixture 110A, 110B. Step 910 includes attaching a housing 220 of the lighting module 106A-106G to left and right raceway walls 210A, 210B of the raceway element 104 at a first housing position, such that the housing 220, the driver 224, and the light fixture 110A, 110B are supported by the raceway element 104.

Any of the embodiments disclosed herein may include power or driver circuitry (e.g., embodied in a driver) having a buck regulator, a boost regulator, a buck-boost regulator, a fly-back converter, a SEPIC power supply or the like and/or a multiple stage power converter employing the like, and may comprise a driver circuit as disclosed in U.S. Patent Application Publication No. 2015/0312983 by Hu et al., published Oct. 29, 2015, entitled "High Efficiency Driver Circuit with Fast Response" and U.S. Pat. No. 9,303,823 by Hu et al., issued Apr. 5, 2016, entitled "SEPIC Driver Circuit with Low Input Current Ripple," both of which are incorporated by reference herein. The driver circuit may further be used with light control circuitry that controls color temperature of any of the embodiments disclosed herein, such as disclosed in U.S. Patent Application Publication No. 2015/0351187 by McBryde et al., published Dec. 3, 2015, entitled "Lighting Fixture Providing Variable CCT," incorporated by reference herein. Additionally, any of the embodiments described herein can include driver circuitry disclosed in U.S. patent application Ser. No. 15/018,375, titled "Solid State Light Fixtures Having Ultra-Low Dimming Capabilities and Related Driver Circuits and Methods," filed on Feb. 8, 2016 and assigned to the same assignee as the present application, the entirety of this application being incorporated herein by reference.

As used herein, the term "LED" may comprise packaged LED chip(s) or unpackaged LED chip(s), LED elements, or LED modules of the same or different types and/or configurations. (The term "LED module" differs from a "lighting module" mountable to a raceway element described herein. Although a lighting module may include one or more LED modules, the inverse is not true.) The LEDs can comprise single or multiple phosphor-converted white and/or color LEDs, and/or bare LED chip(s) mounted separately or together on a single substrate or package that comprises, for example, at least one phosphor-coated LED chip either alone or in combination with at least one color LED chip, such as a green LED, a yellow LED, a red LED, etc. A LED module can comprise phosphor-converted white or color LED chips and/or bare LED chips of the same or different colors mounted directly on a printed circuit board (e.g., chip on board) and/or packaged phosphor-converted white or color LEDs mounted on the printed circuit board, such as a metal core printed circuit board or FR4 board. In some embodiments, the LEDs can be mounted directly to a heat sink, a mounting plate, or another type of board or substrate. Depending on the embodiment, the lighting device can employ LED arrangements or lighting arrangements using remote phosphor technology as would be understood by one of ordinary skill in the art, and examples of remote phosphor technology are described in U.S. Pat. No. 7,614,759, assigned to the assignee of the present invention and hereby incorporated by reference.

In those cases where a soft white illumination with improved color rendering is to be produced, each LED element or LED module or a plurality of such LED elements or LED modules may include one or more blue shifted yellow LEDs and one or more red or red/orange LEDs as described in U.S. Pat. No. 7,213,940, assigned to the assignee of the present invention and hereby incorporated by reference. In some embodiments, each LED element or LED module or a plurality of such LED elements or LED modules may include one or more blue LEDs with a yellow or green phosphor and one or more blue LEDs with a red phosphor. The LEDs may be disposed in different configurations and/or layouts as desired, for example utilizing single or multiple strings of LEDs where each string of LEDs comprises LED chips in series and/or parallel. Different color temperatures and appearances could be produced using other LED combinations of single and/or multiple LED chips packaged into discrete packages and/or directly mounted to a printed circuit board as a chip-on board arrangement. In one embodiment, a light source comprises any LED, for example, an XP-Q LED incorporating TrueWhite® LED technology or as disclosed in U.S. Patent Application Publication No. 2013/0328073 by Lowes et al., published Dec. 12, 2013, entitled "LED Package with Multiple Element Light Source and Encapsulant Having Planar Surfaces," the disclosure of which is hereby incorporated by reference herein, as developed and manufactured by Cree, Inc., the assignee of the present application. If desirable, other LED arrangements are possible. In some embodiments, a string of LEDs, a group of LEDs, or individual LEDs can comprise different lighting characteristics, and by independently controlling a string of LEDs, a group of LEDs, or individual LEDs, characteristics of the overall light output of a device can be controlled.

In some embodiments, each LED element or LED module may comprise one or more LEDs disposed within a coupling cavity with an air gap being disposed between the LED element or LED module and a light input surface. In any of the embodiments disclosed herein, each of the LED element(s) or LED module(s) can have different or the same light distributions, although each may have a directional emission distribution (e.g., a side emitting distribution), as necessary or desirable. More generally, any Lambertian, symmetric, wide angle, preferential-sided or asymmetric beam pattern LED element(s) or LED module(s) may be used as the light source.

Depending on the embodiment, the desired light distribution can be achieved by single primary optics of packaged LEDs and/or combinations of the primary optics of packaged LEDs with single or multiple secondary optics. Optical components can be the same or vary from LED element to LED element depending on the desired lighting characteristics of a luminaire. In some embodiments, LED optics can employ waveguide technology where internal reflection of light is utilized along with light extraction features to achieve a desired light distribution.

In various embodiments described herein, various smart technologies may be incorporated in lighting apparatuses as described in: U.S. Pat. No. 8,736,186 issued May 27, 2014, entitled "Solid State Lighting Switches and Fixtures Providing Selectively Linked Dimming and Color Control and Methods of Operating," which is incorporated by reference herein in its entirety; U.S. Patent Application Publication No. 2014/0001959 published Jan. 2, 2014, entitled "Master/Slave Arrangement for Lighting Fixture Modules," which is incorporated by reference herein in its entirety; U.S. Pat. No. 9,155,165, issued Oct. 6, 2015, entitled "Lighting Fixture for Automated Grouping," which is incorporated by reference herein in its entirety; U.S. Pat. No. 8,975,827, issued Mar. 10, 2015, entitled "Lighting Fixture for Distributed Control," which is incorporated by reference herein in its entirety; U.S. Pat. No. 9,155,166, issued Oct. 6, 2015, entitled "Efficient Routing Tables for Lighting Networks," which is incorporated by reference herein in its entirety; U.S. Pat. No. 9,433,061, issued Aug. 30, 2016, entitled "Handheld Device for Communicating with Lighting Fixtures," which is incorporated by reference herein in its entirety; U.S. Pat. No. 8,829,821, issued Sep. 9, 2014, entitled "Auto Commissioning Lighting Fixture," which is incorporated by reference herein in its entirety; U.S. Pat. No. 8,912,735, issued Dec. 16, 2014, entitled "Commissioning for a Lighting Network," which is incorporated by reference herein in its entirety; U.S. Patent Application Publication No. 2014/0268790, published Sep. 18, 2014, entitled "Ambient Light Monitoring in a Lighting Fixture," which is incorporated by reference herein in its entirety; U.S. Patent Application Publication No. 2015/0102729, published Apr. 16, 2015, entitled "System, Devices and Methods for Controlling One or More Lights," which is incorporated by reference herein in its entirety; and U.S. Provisional Patent Application No. 61/932,058, filed Jan. 27, 2014, entitled "Enhanced Network Lighting," which is incorporated by reference herein in its entirety.

Additionally, any of the luminaire embodiments described herein can include the smart lighting control technologies disclosed in U.S. Provisional Application Ser. No. 62/292,528, filed Feb. 8, 2016, entitled "Distributed Lighting Network," and disclosed in U.S. Patent Application Publication No. 2015/0195883A1, published Jul. 9, 2015, entitled "Power over Ethernet Lighting Fixture," both assigned to the same assignee as the present application, with the entireties of the foregoing documents being incorporated herein by reference.

Any of the embodiments disclosed herein may be used in a lighting apparatus (e.g., a luminaire) having one or more communication components forming a part of a light control circuitry, such as an RF antenna that senses RF energy. Communication components may be included, for example, to allow the lighting apparatus to communicate with other lighting apparatuses and/or with an external wireless controller, such as disclosed in U.S. Pat. No. 8,975,827, issued Mar. 10, 2015, entitled "Lighting Fixture for Distributed Control," U.S. Provisional Application No. 61/932,058, filed Jan. 27, 2014, entitled "Enhanced Network Lighting," or U.S. Patent Application Publication No. 2015/0195883A1, published Jul. 9, 2015, entitled "Power over Ethernet Lighting Fixture, all of which owned by the assignee of the present application. More generally, the control circuitry can include at least one of a network component, an RF component, a control component, or one or more sensors. A sensor, such as a knob-shaped sensor, may provide an indication of ambient lighting levels and/or occupancy within a room or illuminated area. Other sensors are possible, and a sensor may be integrated into the light control circuitry as described herein Those skilled in the art will recognize improvements and modifications to the preferred embodiments of the present disclosure. All such improvements and modifications are considered within the scope of the concepts disclosed herein and the claims that follow.

What is claimed is:

1. A raceway element configured to support at least one light fixture from above, the raceway element comprising:

a plurality of raceway walls including a left raceway wall, a right raceway wall opposing the left raceway wall, and an upper raceway wall spanning generally between the left raceway wall and the right raceway wall, wherein at least a portion of the left raceway wall and at least a portion of the right raceway wall extend downward relative to the upper raceway wall;

a first raceway conductor extending substantially an entire length of at least one raceway wall of the plurality of raceway walls, wherein the first raceway conductor is arranged within a first channel defined by at least one insulating element, and at least 50% of the first channel is devoid of a lower boundary such that at least 50% of a length of the first raceway conductor is exposed along a lower surface of the at least one insulating element; and a second raceway conductor extending substantially the entire length of the at least one raceway wall of the plurality of raceway walls, wherein the second raceway conductor is arranged within a second channel defined by the at least one insulating element, and at least 50% of the second channel is devoid of a lower boundary such that at least 50% of a length of the second raceway conductor is exposed along the lower surface of the at least one insulating element.

2. The raceway element of claim 1, wherein the at least one insulating element comprises a first insulating element arranged on or supported by the left raceway wall, and a second insulating element arranged on or supported by the right raceway wall.

3. The raceway element of claim 1, wherein the at least one insulating element comprises at least one extruded insert that is mechanically retained by the at least one raceway wall of the plurality of raceway walls.

4. The raceway element of claim 1, wherein medial, lateral, and upper portions of each of the first channel and the second channel are bounded by the at least one insulating element.

5. The raceway element of claim 1, wherein the left raceway wall comprises a distal surface that opposes a medial surface of the left raceway wall, the right raceway wall comprises a distal surface that opposes a medial surface of the right raceway wall, and the raceway element further comprises:

at least one of (i) a first longitudinal groove defined in the distal surface of the left raceway wall or (ii) a first longitudinal lip protruding from the distal surface of the left raceway wall; and at least one of (i) a second longitudinal groove defined in the distal surface of the right raceway wall or (ii) a second longitudinal lip protruding from the distal surface of the right raceway wall.

6. The raceway element of claim 1, further comprising:

a third raceway conductor extending substantially the entire length of the at least one raceway wall of the plurality of raceway walls, wherein the third raceway conductor is arranged within a third channel defined by the at least one insulating element, and at least 50% of the third channel is devoid of a lower boundary such that at least 50% of a length of the third raceway conductor is exposed along the lower surface of the at least one insulating element; and a fourth raceway conductor extending substantially the entire length of the at least one raceway wall of the plurality of raceway walls, wherein the fourth raceway conductor is arranged within a fourth channel defined by the at least one insulating element, and at least 50% of the fourth channel is devoid of a lower boundary such that at least 50% of a length of the fourth raceway conductor is exposed along the lower surface of the at least one insulating element.

7. The raceway element of claim 6, wherein each of the first channel, the second channel, the third channel, and the fourth channel is horizontally offset from the others.

8. The raceway element of claim 6 further comprising a fifth raceway conductor extending substantially the entire length of the at least one raceway wall of the plurality of raceway walls, wherein the fifth raceway conductor is arranged within a fifth channel defined by the at least one insulating element, and at least 50% of the fifth channel is devoid of a lower boundary such that at least 50% of a length of the fifth raceway conductor is exposed along the lower surface of the at least one insulating element, wherein the fifth raceway conductor is configured to provide electrical grounding.

9. A method for fabricating a modular lighting system including a raceway element according to claim 1, the method comprising:

mounting the raceway element to or below a ceiling;

attaching an electrical connector of a lighting module into the raceway element at a first connector position to establish conductive electrical communication between of the first and second electrical conductors of the raceway element and first and second electrical contacts arranged atop a plurality of ridges of the electrical connector, respectively, wherein the electrical connector is electrically coupled with a driver electrically coupled with a light fixture; and attaching a housing of the lighting module to left and right raceway walls of the raceway element at a first housing position, such that the housing, the driver, and the light fixture are supported by the raceway element.

10. A modular lighting apparatus, comprising:

a raceway element comprising a left raceway wall, a right raceway wall opposing the left raceway wall, an upper raceway wall spanning generally between the left raceway wall and the right raceway wall, a plurality of electrical conductors, and a first mechanical coupling structure; wherein at least a portion of the left raceway wall and at least a portion of the right raceway wall extend downward relative to the upper raceway wall; and a lighting module comprising:

a housing comprising a left housing wall, a right housing wall opposing the left housing wall, a transverse support arranged between the left housing wall and the right housing wall, and a second mechanical coupling structure configured to mate with the first mechanical coupling structure for removable attachment of the housing to the raceway element;

at least one light-emitting element supported by the housing; and an electrical interconnect structure providing a plurality of electrical connections between the lighting module and the raceway element;

wherein the lighting module is configured for mechanical and electrical coupling to the raceway element at any one module position of a plurality of module positions, wherein the plurality of module positions includes first and second module positions that overlap with one another.

11. The modular lighting apparatus of claim 10, wherein the lighting module is configured for mechanical and electrical coupling to the raceway element at any continuously variable position between the first module position and the second module position.

12. The modular lighting apparatus of claim 10, wherein the housing of the lighting module is configured to be attached to the raceway element by vertical translation of the housing relative to the raceway element, and wherein the housing is non-rotatable relative to the raceway element once attached thereto.

13. The modular lighting apparatus of claim 10, wherein the raceway element is configured to be electrically interconnected with at least one other raceway element.

14. The modular lighting apparatus of claim 10, wherein the at least one light-emitting element and the housing are embodied in at least one light fixture.

15. The modular lighting apparatus of claim 14, wherein the at least one light-emitting element comprises a plurality of LEDs, the at least one light fixture comprises a lens or diffuser, the lens or diffuser is attached to a lower portion of the housing, and the plurality of LEDs is positioned between the transverse support of the housing and the lens or diffuser.

16. The modular lighting apparatus of claim 15, wherein the lighting module further comprises a driver mounted within the housing, and the driver is electrically coupled between the electrical interconnect structure and the plurality of LEDs.

17. The modular lighting apparatus of claim 10, wherein the lighting module comprises a track supported by the housing, wherein the track provides mechanical and electrical connections with the at least one light-emitting element, and the at least one light-emitting element is embodied in at least one track light fixture that is positionable at any one of multiple positions along the track.

18. The modular lighting apparatus of claim 10, wherein at least a portion of each electrical conductor of the plurality of electrical conductors is exposed along a lower surface thereof within the raceway element.

19. The modular lighting apparatus of claim 18, wherein the electrical interconnect structure comprises an electrical connector comprising:

a base portion;

a plurality of ridges extending upwardly from the base portion and a plurality of electrical contacts associated with the plurality of ridges, wherein each ridge of the plurality of ridges comprises an insulating material and comprises a different electrical contact of the plurality of electrical contacts, and each electrical contact of the plurality of electrical contacts is configured to contact the different electrical conductor of the plurality of electrical conductors of the raceway element; and a plurality of terminals defined in or on the base portion and configured to receive a plurality of electrical wires from the lighting module, wherein each terminal of the plurality of terminals is in conductive electrical communication with a different electrical contact of the plurality of electrical contacts, and each terminal of the plurality of terminals is configured to removably receive a different electrical wire of the plurality of electrical wires.

20. An electrical connector for establishing electrical connections between a raceway element and a light fixture, the electrical connector comprising:

a base portion;

a plurality of ridges extending upwardly from the base portion and a plurality of electrical contacts associated with the plurality of ridges, wherein each ridge of the plurality of ridges comprises an insulating material and comprises a different electrical contact of the plurality of electrical contacts, and each electrical contact of the plurality of electrical contacts is configured to contact a different electrical conductor of a plurality of electrical conductors of the raceway element; and a plurality of terminals defined in or on the base portion and configured to receive a plurality of electrical wires from the light fixture, wherein each terminal of the plurality of terminals is in conductive electrical communication with a different electrical contact of the plurality of electrical contacts, and each terminal of the plurality of terminals is configured to removably receive a different electrical wire of the plurality of electrical wires;

wherein the electrical connector is configured to be mechanically and electrically coupled to the raceway element upon vertical translation of the electrical connector into at least a portion of the raceway element.

21. The electrical connector of claim 20, wherein each ridge of the plurality of ridges comprises one or more openings with the electrical contact of the ridge being at least partially exposed through the one or more openings.

22. The electrical connector of claim 20, wherein each ridge of the plurality of ridges comprises sidewalls that taper to a narrowed tip having one or more openings, and the electrical contact of the ridge being at least partially exposed through the one or more openings.

* * * * *